US006331215B1

(12) United States Patent
Toge et al.

(10) Patent No.: US 6,331,215 B1
(45) Date of Patent: Dec. 18, 2001

(54) PROCESS FOR PRODUCING GRAIN-ORIENTED ELECTROMAGNETIC STEEL SHEET

(75) Inventors: Tetsuo Toge; Michiro Komatsubara; Atsuhito Honda; Kenichi Sadahiro; Kunihiro Senda, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/493,864

(22) Filed: Jan. 28, 2000

Related U.S. Application Data

(62) Division of application No. 08/954,504, filed on Oct. 20, 1997, now Pat. No. 6,039,818.

(30) Foreign Application Priority Data

Oct. 21, 1996 (JP) ..... 8-278136
Oct. 29, 1996 (JP) ..... 8-286720
Nov. 8, 1996 (JP) ..... 8-313098

(51) Int. Cl.[7] ..... H01F 1/04
(52) U.S. Cl. ..... 148/111; 148/113
(58) Field of Search ..... 148/110–113

(56) References Cited

U.S. PATENT DOCUMENTS 4,168,189 9/1979 Haselkorn et al. .
4,213,804 * 7/1980 Datta ..... 148/111
4,576,658 * 3/1986 Inokuti et al. ..... 148/111
4,579,608 4/1986 Shimizu et al. .
5,415,703 5/1995 Ushigami et al. .
5,718,775 2/1998 Komatsubara et al. .
5,961,744 * 10/1999 Yamazaki et al. ..... 148/113

FOREIGN PATENT DOCUMENTS 33 34 519 3/1984 (DE) .
0 047 129 3/1982 (EP) .
0 184 891 6/1986 (EP) .
0 374 948 6/1990 (EP) .
57 089433 6/1982 (JP) .
57 207 114 12/1982 (JP) .
08 143964 6/1996 (JP) .

* cited by examiner

*Primary Examiner*—John P. Sheehan
(74) *Attorney, Agent, or Firm*—Schnader Harrison Segal & Lewis LLP

(57) ABSTRACT

A grain-oriented electromagnetic steel sheet is provided which has a low ratio of iron loss in a weaker magnetic field to that in a stronger magnetic field and has special advantage in EI cores and the like. Also provided is a process for producing that steel sheet. The grain-oriented electromagnetic steel sheet is characterized in that its crystal grains of important components are specified in terms of their proportions in number, and the contents of Al, Ti and B, with a forsterite film formed on a surface of the steel sheet. In the process a low-Al silicon slab is heated at below 1,250° C. before hot rolling and the hot-rolled sheet is annealed with a temperature rise in the range of from 5 to 25° C./sec and at a temperature of from about 800 to 1,000 for a period of time of shorter than about 100 seconds.

16 Claims, 6 Drawing Sheets

PROCESS FOR PRODUCING GRAIN-ORIENTED ELECTROMAGNETIC STEEL SHEET

This application is a divisional of application Ser. No. 08/954,504, filed Oct. 20, 1997, now U.S. Pat. No. 6,039,818 incorporated herein by reference.

BACKGROUND OF THE INVENTION

1. Field of the Invention

This invention relates to grain-oriented electromagnetic steel sheets typically used as iron cores in electric generators and transformers, for example. More particularly, the invention relates to a grain-oriented electromagnetic steel sheet having a low ratio of iron loss in a weaker magnetic field to iron loss in a stronger magnetic field. Such sheets are suitably applicable to iron cores for small size electric generators and as E.I. cores for small scale transformers. The invention further relates to a process for production of such steel sheets.

2. Description of the Related Art

Grain-oriented electromagnetic steel sheets are used as iron core materials particularly for large-scale transformers and other electrical equipment. In general, such a steel sheet is required to have a low iron loss taken as the loss occurring upon magnetization of the steel sheet to 1.7 T at 50 Hz, and defined as $W_{17/50}$ (W/kg). As a consequence, intensive research has been conducted with a view to reducing the value of $W_{17/50}$. To prevent hysteresis loss among other iron losses, a certain technique is disclosed which causes the crystal grains of the finished steel sheet to be converged to the full extent possible to a {110} <001> orientation in which easy-to-magnetize axes <001> are arranged in a regular order in the rolling direction.

The grain-oriented electromagnetic steel sheet has been produced generally by use of complex process steps:

1) A slab 100 to 300 mm in thickness is subjected to heating and subsequently to hot rolling consisting of rough rolling and finish rolling, to prepare a hot-rolled sheet.
2) The hot-rolled sheet is cold-rolled once or twice or more times with intermediate annealing to reach a final sheet thickness.
3) The cold-rolled sheet is decarburization-annealed.
4) With an annealing separator coated over the decarburization-annealed sheet, finish annealing is performed to attain secondary recrystallization and purification.
5) Flattening annealing and insulating coating are applied to the finishing-annealed sheet, whereby a steel sheet product is obtained.

In the above method, those crystal grains directed to a {110} <001> orientation are allowed to grow through secondary recrystallization while in finishing annealing. To permit crystal grains to be grown in a {110} <001> orientation in an effectively conducted manner by means of secondary recrystallization, it is of importance that precipitation (commonly using an inhibitor) be made dispersible into a uniform and proper size, causing the inhibitor to prevent growth of crystal grains primarily recrystallized. One suitable inhibitor is typified by sulfides such as MnS, Se compounds such as MnSe, nitrides such as AIN and VN and so on, but they have a markedly weak tendency to dissolve into the steel.

In a conventional method of properly controlling such an inhibitor, the inhibitor has been completely solid-solubilized upon heating of the slab prior to hot rolling, followed by precipitation of such inhibitor in a subsequent hot rolling stage. In this instance, the slab needs to be heated at a temperature of about 1,400° C. to produce a fully solid-solubilized inhibitor. This temperature is higher by about 200° C. than that usually used in heating a steel slab. Slab heating at such a high temperature suffers from the following defects.

1) Substantial energy is consumed due to heating at an elevated temperature.
2) Melt scale and slab sagging tend to take place.
3) Excessive decarburization is likely to occur on the slab surface.

To solve the above defects 1) and 2) above, use of an induction heating furnace has been proposed for exclusive use in producing the grain-oriented electromagnetic steel sheet. However, such furnace causes a rise in energy cost. There is a keen demand for saving energy. To date, therefore, many persons skilled in the art have endeavored to practice slab heating at lower temperatures.

For instance, Japanese Examined Patent Publication No. 54-24685 discloses that the slab heating temperature can be set in a range of 1,050 to 1,350° C. by incorporating into the steel such elements as As, Bi, Sb and the like, that segregate at a grain boundary, and by taking advantage of these elements as inhibitors. Japanese Unexamined Patent Publication No. 57-158332 teaches that the slab heating temperature can be lowered and the Mn content reduced with an Mn/S ratio of below 2.5, and that secondary recrystallization can be stably effected by addition of Cu. Additionally, Japanese Unexamined Patent Publication No. 57-89433 discloses conducting slab heating at a reduced temperature of 1,100 to 1,250° C. by adding elements such as S, Se, Sb, Bi, Pb, B and the like together with Mn, and by taking a columnar structure ratio of the slab in combination with reduction of secondary cold rolling. However, since such known techniques are designed to omit AlN as an inhibitor having an extremely weak ability to dissolve into the steel, they fail to produce sufficient benefit from the inhibitors used, and hence create magnetic characteristics that are still far from acceptable. Eventually they have been used only for laboratory purposes.

In Japanese Unexamined Patent Publication No. 59-190324, a technique is taught in which pulse annealing can be employed at the time of annealing for primary recrystallization. This mode of production is also useful on a laboratory scale, but not on a commercial basis. Japanese Unexamined Patent Publication No. 59-56522 discloses heating a slab at a lower temperature with the Mn controlled to a content of 0.08 to 0.45% and with S less than 0.007%; Japanese Unexamined Patent Publication No. 59-190325 teaches stabilizing secondary recrystallization by further incorporation of Cr in the composition of 59-190325 cited above. While such prior art techniques are characterized with a small content of S, MnS is caused to solid-solubilize during slab heating, and such techniques have the disadvantage that upon use of their respective steel sheets for heavy weight coils, the resultant magnetic characteristics become irregular in the widthwise or lengthwise direction.

Japanese Unexamined Patent Publication No. 57-207114 discloses using a composition having a noticeably low content of carbon (C: 0.002 to 0.010%) in combination with a low slab heating temperature. This is attributable to the fact that where the slab heating temperature is low, absence of exposure to the austenite phase at stages from solidification to hot rolling is rather desirable for effecting subsequent secondary recrystallization. Such a low carbon content can avoid breakage during cold rolling, but nitridation is necessary in decarburization annealing in order to ensure stable secondary recrystallization.

With that technique in view, considerable technological development has been conducted on the basis that intermediate nitridation is employed. Namely, Japanese Unexamined Patent Publication No. 62-70521 discloses specifying finishing-annealing conditions and thus conducting slab heating at a low temperature by means of intermediate nitridation while in finishing annealing. Moreover, Japanese Unexamined Patent Publication No. 62-40315 teaches incorporating Al and N in amounts that cannot undergo solid solubilization during slab heating, thereby controlling the associated inhibitor in a proper state with reliance upon intermediate nitridation. Intermediate nitridation at the time of decarburization annealing, however, poses the drawback that it needs added equipment and hence increased cost. Another but serious drawback is that it is difficult to control nitridation in the step of finishing annealing.

On the other hand, one difficulty has of late arisen that the iron loss properties of a starting material do not always conform to those of the end-use product resulting from such material. It has been found, in fact, that in the case of iron cores for large-scale transformers, a starting material having a low value of $W_{17/50}$ leads to an end-use product having excellent iron loss properties. Despite this finding, in the case of iron cores for electric generators of a small scale, or EI cores for use as small-scale transformers, the corresponding steel sheet has a complex magnetic flux running therein, with the consequence that the $W_{17/50}$ value of the steel sheet does not necessarily match the iron loss properties of the resulting end product. As a result of the present energy crisis, reduction of energy waste must be reduced, and serious efforts have been made to decrease the iron losses of the end-use products. Any values of $W_{17/50}$ as related to starting materials are not sufficient to correctly evaluate the end-use products. This has often created difficulty in selecting optimum materials to be used as starting materials.

In reducing the iron loss of a starting material, it is generally known to provide a method in which electrical resistance is increased by addition of Si that acts to effectively decrease eddy-current loss, or a method in which a steel sheet is decreased in thickness, or a method in which crystals are decreased in grain sizes, or a method in which magnetic flux is improved in density by converging crystal orientations to {110} <001> to a great extent. The method of improving a magnetic flux density, amongst the above methods, has been widely studied to date. In Japanese Patent Publication No. 51-2290, for example, it is disclosed that with Al added as an inhibitor component to steel, slab heating is effected at a high temperature of above 1,300° C., finishing rolling for hot rolling is conducted at a high temperature for a short. period of time, and hot rolling is done at a final temperature of above 980° C. Japanese Patent Publication No. 46-23820 discloses that with Al added to steel, particulate AlN is allowed to precipitate by annealing the hot-rolled steel sheet at a high temperature of 1,000 to 1,200° C. and by subsequently quenching the annealed steel sheet; also the quenched steel sheet is subjected to cold rolling with a high reduction of 80 to 95%. Thus, a steel material is made available which offers a noticeably high magnetic flux density of 1.95 T at $B_{10}$, and a low iron loss.

In regard to the method which is designed to achieve improved magnetic flux density by arrangement of crystal orientations and which has conventionally been used in reducing $W_{17/50}$ it cannot be said that such method is effective for improving the iron loss properties of EI cores or iron cores for small-scale generators. One reason for this is that the magnetic flux distributed in a steel sheet is complex, as in the case of the EI cores.

To decrease the iron loss without use of the magnetic flux density-improving method, there have been considered a method in which Si is added in a large amount, a method in which the steel sheet is decreased in thickness, and a method in which crystals are reduced in grain size. In the Si content-increasing method, excess Si leads to impaired rolling of and diminished workability of a steel sheet. The steel sheet thickness-decreasing method produces a sharp rise in production cost.

SUMMARY OF THE INVENTION

Accordingly, the present invention has as an object to provide a grain-oriented electromagnetic steel sheet which is useful for making EI cores and small-scale generators. The invention also provides a process for production of such a steel sheet.

The process of this invention can create such a steel sheet by effecting slab heating at a temperature usually used in heating general-purpose steel, with no positive need for intermediate nitridation or otherwise, with significant energy savings and also with simplified process steps.

We have discovered that a grain-oriented electromagnetic steel sheet suited for EI cores and small-scale generators is peculiar in that it has high iron loss $W_{17/50}$ in a strong magnetic field, and a low iron loss $W_{10/50}$ in a weak magnetic field; it has a low ratio of $W_{10/50}$ to $W_{17/50}$. It has been unexpectedly discovered that the proportion of number of fine grains to numbers of coarse grains should be controlled to the optimum at a given value in the crystal grain distribution of the resulting steel sheet, and that a particular film should be formed on the surface of the steel sheet. The film discovered is a forsterite containing Al, Ti and B in special amounts.

Another surprising finding is that such steel sheet can be made by a process which satisfies all of the following requirements.

1) Reduced content of Al in a grain-oriented silicon steel slab.
2) Incorporation of a nucleating component to permit precipitation of AlN in the grain-oriented silicon steel slab.
3) Solid solubilization of AlN and preventing crystal grain growth by slab heating at a low temperature.
4) Selection of hot rolling conditions to enable solid solubilization of AlN in a hot-rolled steel sheet.
5) Selection of annealing conditions to permit precipitation of particulate AlN in the hot-rolled steel sheet.
6) Practice of cold rolling with use of a tandem rolling mill to increase crystal grains in a {110} <001> orientation.
7) Optimization of decarburization-annealing atmosphere to maintain AlN in a given form.
8) Selection of an annealing separator and optimization of a finishing-annealing atmosphere to control the film.

More specifically, the present invention in one aspect provides a grain-oriented electromagnetic steel sheet having a low-ratio of iron loss in a weak magnetic field to that in a strong magnetic field, which steel comprises:

Si in a content of about 1.5 to 7.0% by weight, Mn in a content of about 0.03 to 2.5% by weight, C in a content of less than about 0.003% by weight, S in a content of less than about 0.002% by weight and N in a content of less than about 0.002% by weight;

A proportion of numbers of crystal grains having a grain diameter of smaller than 1 mm being about 25 to 98%, a proportion of numbers of crystal grains having a grain diameter of being 4 to 7 mm being less than about 45% and a proportion of numbers of crystal grains having a grain diameter of larger than 7 mm being less than about 10%, each grain in this thickness direction of the steel sheet being located inwardly of the steel surface; and a film disposed over the surface of the steel sheet composed of forsterite containing Al in an amount of about 0.5 to 15% by weight, Ti in an amount of about 0.1 to 10% by weight and B in an amount of about 0.01 to 0.8% by weight.

In another aspect, the invention provides a process for the production of a grain-oriented electromagnetic steel sheet having a low ratio of iron loss in a weak magnetic field to that in a strong magnetic field, which comprises:

casting a molten steel into a silicon steel slab, the molten steel comprising about,
C: 0.005 to 0.070% by weight,
Si: 1.5 to 7.0% by weight,
Mn: 0.03 to 2.5% by weight,
Al: 0.005 to 0.017% by weight and
N: 0.0030 to 0.0100% by weight, the molten steel further including at least one member selected from the group consisting of,
Ti: about 0.0005 to 0.0020% by weight,
Nb: about 0.0010 to 0.010% by weight,
B: about 0.0001 to 0.0020% by weight and
Sb: about 0.0010 to 0.080% by weight, subjecting the slab to hot rolling by heating at a temperature of lower than about 1,250° C., or to direct hot rolling;

outlet temperature of finish hot rolling being in the range of about 800 to 970° C., followed by quenching the steel sheet at a cooling speed of above about 10° C./sec and by subsequent winding of the same in coiled form at a temperature of lower than about 670° C.;

annealing the resultant sheet while the same is being maintained at a temperature of about 800 to 1,000° C. for a period of shorter than 100 seconds with a temperature rise of about 5 to 25° C./sec;

cold-rolling the annealed sheet at a reduction of about 80 to 95% with use of a tandem rolling mill;

decarburization-annealing the cold-rolled sheet with a ratio of partial steam pressure to partial hydrogen pressure ($P(H_2O)/P(H_2)$) below about 0.7 in the course of constant heating and with $P(H_2O)/P(H_2)$ lower in the course of temperature rise than in the constant heating;

coating an annealing separator on the decarburization-annealed sheet, the separator containing a Ti compound in an amount of about 1 to 20% by weight and B in an amount of about 0.04 to 1.0% by weight; and subsequently finish annealing the coated sheet while the same is being subjected to temperature rise or being maintained in a hydrogen-containing atmosphere at least above about 850° C. in the course of temperature rise.

In a further aspect, the invention provides a process for the production of a grain-oriented electromagnetic steel sheet having a low ratio of iron loss in a weak magnetic field to that in a strong magnetic field, which comprises:

casting a molten steel into a silicon steel slab, the molten steel comprising about,
C: 0.005 to 0.070% by weight,
Si: 1.5 to 7.0% by weight,
Mn: 0.03 to 2.5% by weight,
Al: 0.005 to 0.017% by weight,
N: 0.0030 to 0.0100% by weight and
Sb: 0.0010 to 0.080% by weight, subjecting the slab to hot rolling by heating at a temperature of lower than about 1,250° C., or to direct hot rolling;

finishing hot rolling being at a temperature of higher than about 900° C. at an inlet side and with a cumulative reduction of first 4 passes of above about 90%;

annealing the resultant sheet while the same is being maintained at a temperature of about 800 to 1,000° C. for a period of shorter than 100 seconds with a temperature rise of from about 5 to 25° C./sec;

cold-rolling the annealed sheet at a reduction of about 80 to 95% with use of a tandem rolling mill;

decarburization-annealing the cold-rolled sheet with $P(H_2O)/P(H_2)$ set to be below about 0.7 in the course of constant heating and with $P(H_2O)/P(H_2)$ lower in the course of temperature rise than in the constant heating;

coating an annealing separator on the decarburization-annealed sheet, the separator containing a Ti compound in an amount of about 1 to 20% by weight and B in an amount of about 0.04 to 1.0% by weight; and subsequently subjecting the coated sheet to finish annealing while the same is being subjected to temperature rise or being maintained in a hydrogen-containing atmosphere at least above about 850° C. in the course of temperature rise.

DESCRIPTION OF THE PREFERRED EMBODIMENTS

Figure 1:
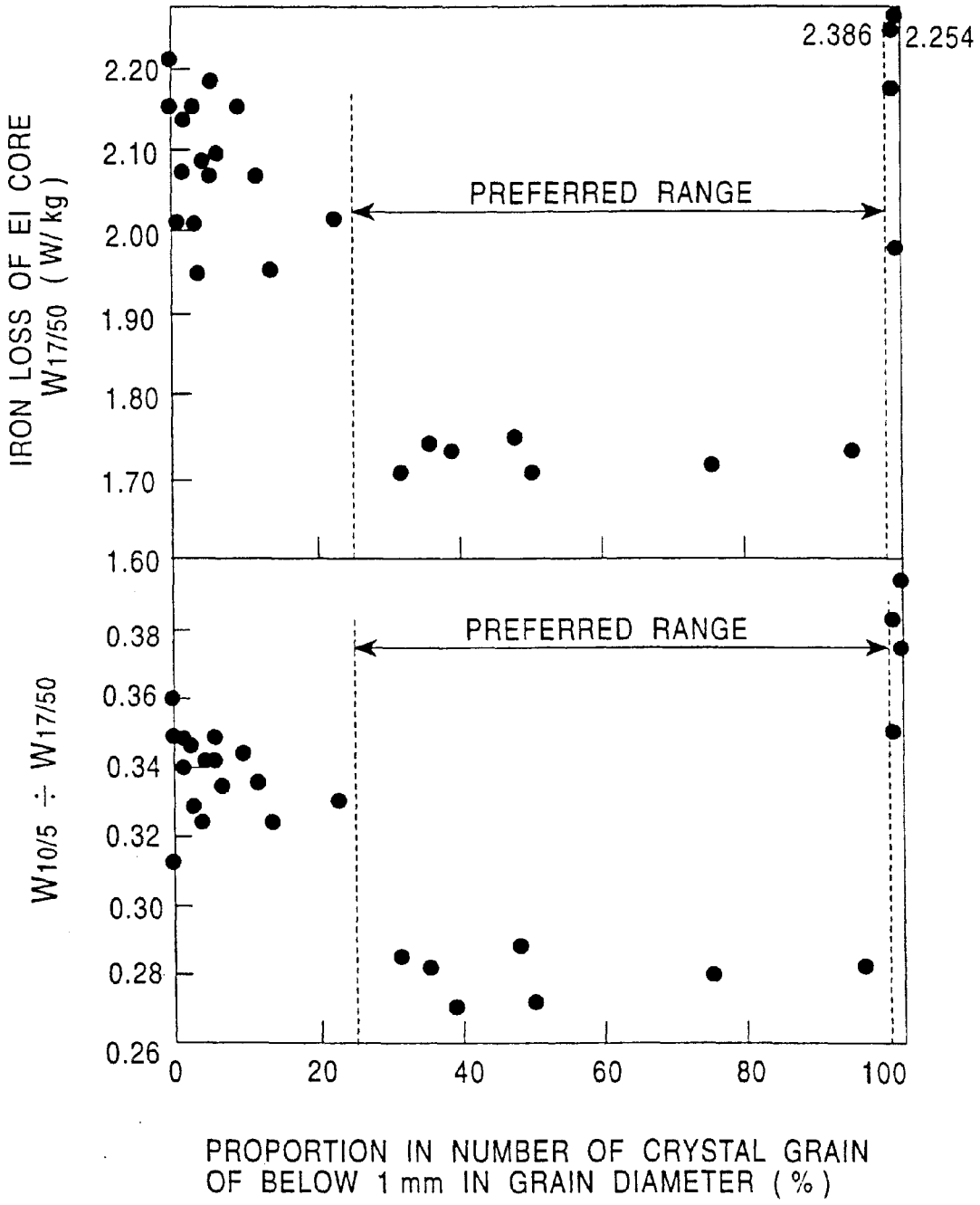
FIG. 1 is a graph representing the relationship between the proportion in number of crystal grains smaller than 1 mm in grain diameter, the iron loss of an EI core and the ratio of $W_{10/50}$ to $W_{17/50}$.

Guidelines were considered for more adequately evaluating starting materials in regard to the iron losses of iron cores of small-scale generators and the iron losses of EI cores. To this end, different kinds of grain-oriented electromagnetic steel sheets were examined in respect of their respective iron loss properties, with the results shown as examples in Table 1.

TABLE 1

| Thickness of steel sheet: 0.30 mm | | | | | |
|---|---|---|---|---|---|
| | Material characteristic | | | | Iron |
| | Magnetic flux | Iron loss | | | loss of EI core |
| Kind of material | density $B_8$ (T) | $W_{10/50}$ (W/kg) | $W_{17/50}$ (W/kg) | $W_{10/50-}$ $W_{17/10}$ | $W_{17/50}$ (W/kg) |
| a | 1.85 | 0.334 | 1.240 | 0.269 | 1.283 |
| b | 1.88 | 0.335 | 1.175 | 0.285 | 1.362 |
| c | 1.91 | 0.352 | 1.123 | 0.313 | 1.490 |
| d | 1.94 | 0.363 | 1.032 | 0.352 | 1.675 |

Table 1 shows that the ratio of $W_{10/50}$ (an iron loss (W/kg) at a magnetic flux density of 1.0 T at 50 Hz) to $W_{17/50}$ is well correlative with the iron loss of an EI core. The reason for this may be as follows:

Magnetic fluxes run in the core when the core is magnetized. The magnetic fluxes run less uniformly in a core of small scale such as an EI core, than in a core of large scale. The uniformity of magnetic fluxes contributes to the iron loss of the core as well as the iron loss of the material sheet. It seems that the uniformity of magnetic fluxes in the EI core is raised when the ratio of $W_{10/50}$ to $W_{17/50}$ is lowered. And the uniformity of magnetic fluxes seems to have greater effect on the iron loss of the EI core than the iron loss of the material sheet. So, low $W_{10/50}/W_{17/50}$ material gives a low $W_{17/50}$ value of the El core. Such is taken as essential to the EI core or the like and thought to be not affected by the size of the same.

Upon examination of materials a and b having given good properties to the resultant EI core, the crystal structure of each such material has proved to be composed of fine grains. Although it is conventionally known that small crystal grains are desirable for decreasing iron losses, this knowledge is derived wholly from research on reducing $W_{17/50}$ values of materials but not from research on reducing the iron losses of EI cores and the like, namely on improving the characteristics of the cores. No studies have been made of the grain size in which crystal grains should be controlled to decrease $W_{10/50}$ and $W_{10/50}/W_{17/50}$ with an increase in $W_{17/50}$. In the existing situation of the prior art, optimum distributions of crystal grain diameters are simply unknown.

A widely known technique of controlling crystal grain diameter in a grain-oriented electromagnetic steel sheet is disclosed for example in Japanese Patent Publication No. 59-20745 in which a grain-oriented electromagnetic steel sheet of a thin type is provided with an average crystal grain diameter of from 1 to 6 mm. Japanese Examined Patent Publication No. 62-56923 discloses reducing iron loss by specifying the number of crystal grains having a grain diameter of smaller than 2 mm as being in a proportion of from 15 to 70%. Further, Japanese Examined Patent Publication No. 6-80172 discloses that an iron loss can be decreased by the presence in mixed condition of fine grains having a diameter of from 1.0 to 2.5 mm. It is to be noted, however, that all of these prior disclosures are directed to the iron losses of $W_{17/50}$ at a magnetic flux density of 1.7 T in a strong magnetic field, not to iron losses in a weak magnetic field.

Based on the results of Table 1, many different experiments were conducted concerning distributions of crystal grain diameters in an end product so as to reduce the iron losses in an EI core, $W_{10/50}$ and $W_{10/50}/W_{17/50}$ of such product and the related production conditions.

Experiment 1 was run to examine the effect of distributions of crystal grain diameters, the contents of Al, the hot rolling conditions and the hot-rolled sheet annealing conditions.

Ten slabs with the composition labeled as steel symbol Al in Table 2 were hot-rolled under those conditions shown as from Xa to Xj in Table 3 to thereby prepare hot-rolled sheet coils with a sheet thickness of 2.4 mm. As a prior art method, a slab of the composition labeled as steel symbol A3 in Table 2 was hot-rolled under those conditions shown as Xh in Table 3 to obtain a hot-rolled sheet coil with the same sheet thickness of 2.4 mm.

TABLE 2

| | Composition (wt %, * wt ppm) | | | | | | | | | | | | | | | | | Grouping |
|---|---|---|---|---|---|---|---|---|---|---|---|---|---|---|---|---|---|---|
| Steel symbol | C | Si | Mn | P | Al | S | Sb | Sn | Cr | Nb * | Cu | Zn | Mo | B * | Ti * | N * | O * | of composition |
| A1 | 0.052 | 3.05 | 0.06 | 0.004 | 0.014 | 0.003 | tr | 881 | 0.01 | 42 | 0.01 | tr | tr | 0.4 | 0.7 | 83 | 9 | Example |
| A2 | 0.043 | 2.99 | 0.07 | 0.011 | 0.004 * | 0.005 | tr | 0.01 | 0.02 | 51 | 0.01 | tr | tr | 0.7 | 3.4 | 85 | 12 | Comparative Ex. |
| A3 | 0.056 | 3.13 | 0.07 | 0.005 | 0.021 * | 0.004 | 0.01 | 0.01 | 0.01 | 29 | 0.02 | tr | tr | 0.4 | 2.0 | 76 | 11 | Comparative Ex. |
| A4 | 0.064 | 3.12 | 0.06 | 0.008 | 0.016 | 0.002 | 0.01 | 0.01 | 0.02 | 32 | 0.01 | tr | tr | 0.0 | 4.2 | 19 * | 8 | Comparative Ex. |
| A5 | 0.055 | 2.96 | 0.07 | 0.018 | 0.015 | 0.008 | tr * | 0.01 | 0.02 | 7 * | 0.01 | tr | tr | 0.3 * | 3.7 * | 80 | 15 | Comparative Ex. |
| A6 | 0.045 | 3.05 | 0.07 | 0.007 | 0.007 | 0.005 | tr | 0.01 | 0.01 | 83 | 0.01 | tr | tr | 0.7 | 3.0 | 81 | *7 | Example |
| A7 | 0.062 | 3.24 | 0.07 | 0.003 | 0.013 | 0.006 | 0.01 | 0.01 | 0.02 | 5 | 0.01 | tr | tr | 0.5 | 4.2 | 75 | 9 | Example |
| A8 | 0.048 | 3.04 | 0.06 | 0.008 | 0.012 | 0.003 | 0.026 | 0.02 | 0.01 | tr | 0.15 | tr | 0.018 | 0.4 | 2.0 | 89 | 18 | Example |
| A9 | 0.042 | 3.17 | 0.06 | 0.009 | 0.016 | 0.009 | tr | 0.02 | 0.02 | tr | 0.01 | tr | tr | 0.6 | 7.4 | 75 | 13 | Example |
| A10 | 0.058 | 3.05 | 0.07 | 0.004 | 0.013 | 0.004 | tr | 0.01 | 0.00 | tr | 0.01 | tr | 0.012 | 17 | 14 | 72 | 11 | Example |
| A11 | 0.044 | 3.26 | 0.07 | 0.009 | 0.015 | 0.006 | tr | 0.13 | 0.02 | tr | 0.01 | 0.005 | tr | 2.0 | 2.4 | 77 | 7 | Example |
| A12 | 0.063 | 3.19 | 0.06 | 0.007 | 0.012 | 0.004 | tr | 0.01 | 0.02 | 42 | 0.01 | tr | tr | 7.5 | 6.5 | 84 | 6 | Example |
| A13 | 0.042 | 3.05 | 0.07 | 0.012 | 0.017 | 0.007 | tr | 0.02 | 0.01 | tr | 0.02 | 0.009 | tr | 15 | 0.9 | 89 | 4 | Example |
| A14 | 0.037 | 2.98 | 0.06 | 0.005 | 0.009 | 0.005 | 0.037 | 0.02 | 0.01 | 59 | 0.18 | *tr | tr | 5.3 | 3.9 | 82 | 16 | Example |
| A15 | 0.049 | 3.09 | 0.07 | 0.008 | 0.014 | 0.006 | tr | 0.01 | 0.02 | tr | 0.02 | tr | tr | 12 | 11.5 | 84 | 7 | Example |

Note: * Outside invention scope

TABLE 3

| Symbol of hot-rolling condition | Temperature of slab heating | Final temperature of hot rolling | Temperature of coil winding |
|---|---|---|---|
| Xa | 1150° C. | 780° C. | 640° C. |
| Xb | 1150° C. | 850° C. | 640° C. |
| Xc | 1150° C. | 850° C. | 730° C. |
| Xd | 1150° C. | 950° C. | 640° C. |
| Xe | 1230° C. | 940° C. | 640° C. |
| Xf | 1230° C. | 990° C. | 640° C. |
| Xg | 1350° C. | 920° C. | 640° C. |
| Xh | 1350° C. | 1020° C. | 640° C. |
| Xi | 1410° C. | 940° C. | 640° C. |
| Xj | 1410° C. | 1050° C. | 640° C. |

At stages from completion of hot rolling to coil winding, cooling was accomplished by quenching at a cooling speed of from 25.3 to 28.6/sec. Thereafter, each of the coils thus obtained was divided into two fragments. One fragment was annealed at 900° C. for 60 seconds and the other at 1,050° C. for 60 seconds. Both fragments were then pickled and warm-rolled to a sheet thickness of 0.34 mm at 150° C. by use of a tandem rolling mill, followed by degreasing of the resulting sheet and by subsequent decarburization-annealing of the same at 850° C. for 2 minutes. Coated over the sheet so treated was an annealing separator which had been prepared by adding $TiO_2$ in an amount of 5% to MgO containing B in an amount of 0.1%. Finishing annealing was conducted in which the annealing temperature was elevated up to 600° C. in an atmosphere of $N_2$ alone, up to 1,050° C. in a mixed atmosphere of 25% of $N_2$ and 75% of $H_2$ and up to 1,200° C. in an atmosphere of $H_2$ alone, and the sheet was maintained at the last temperature for 5 hours. Upon completion of this annealing, unreacted separator was removed. Then, an insulating coating was applied which was composed predominantly of magnesium phosphate containing 40% of colloidal silica, and was baked at 800° C. to provide a steel sheet product.

Subsequently, the finish annealed steel sheet made free of unreacted separator was macroetched to measure the distribution of crystal grain diameters. Additionally, a specimen of an Epstein size was cut out of the steel sheet along its rolling direction and then annealed at 800° C. for 3 hours to relieve strain, and measurement was made of the iron losses $W_{10/50}$ and $W_{17/50}$ as well as the magnetic flux density $B_8$. Moreover, the steel sheet was punched to prepare iron cores for use in an EI core, which iron cores were annealed to relieve strain, and was laminate-molded and copper wire-wound to form the EI core. Iron loss properties of the EI core were checked.

Figure 6:
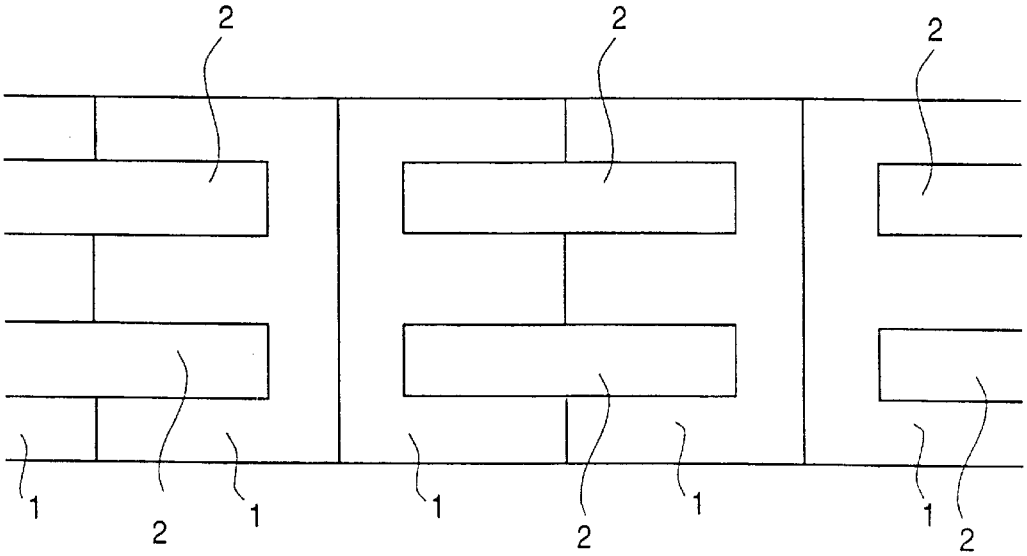
FIG. 6 is a schematic view explanatory of a method for punching EI core material sheets out of a coil.
Figure 7:
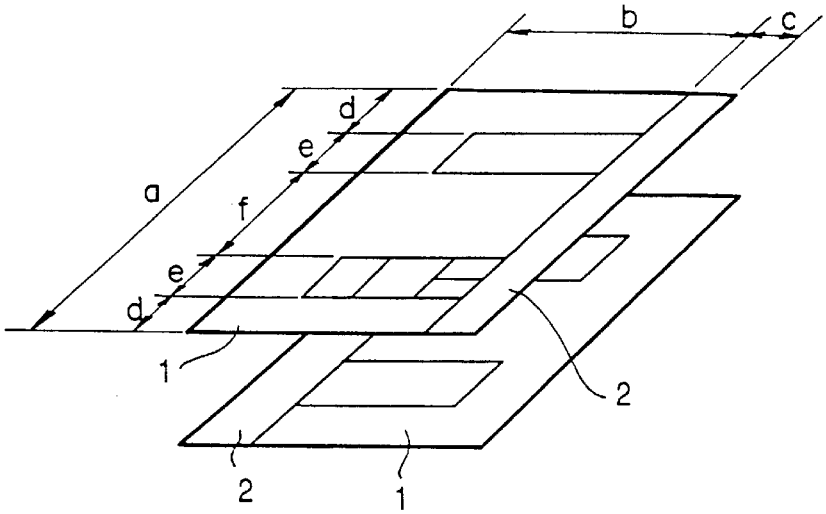
FIG. 7 schematically shows a method of laminating EI core material sheets.

To construct such EI core, a punched E portion 1 and a punched I portion 2 as seen in FIG. 6 are laminated in alternately reversely directed relation to each other as shown in FIG. 7.

The EI core tested was dimensioned: a=48 mm, b=32 mm, c=8 mm, d=8 mm, e=8 mm and f=16 mm in FIG. 7. The number of laminates was 16, and the primary winding of copper wire was 100 turns and the secondary winding 50 turns. Similar conditions applied to subsequent experiments.

The results obtained are shown in Table 4.

TABLE 4 - 1

Thickness of steel sheet: 0.34 mm

| Steel symbol | Symbol of hot rolling | Temperature of annealing hot-rolled sheet (° C.) | Proportion of crystal grain in number (%) Below 1 mm | 1~4 mm | 4~7 mm | Above 7 mm | Average grain diameter (mm) | Iron loss (W/kg) $W_{10/50}$ | $W_{17/50}$ | Iron loss ratio $W_{10/50}/W_{17/50}$ | Magnet flux density $B_8$ (T) | EI core $W_{17/50}$ (W/kg) | Remark |
|---|---|---|---|---|---|---|---|---|---|---|---|---|---|
| A1 | Xa | 900 | 99.4 | 0.1 | 0.1 | 0.3 | 0.48 | 0.783 | >2.0 | — | 1.613 | 2.573 | Bad |
| | | 1050 | 5.4 | 2.9 | 16.4 | 75.3 | 15.6 | 0.413 | 1.208 | 0.342 | 1.904 | 2.074 | Bad |
| | Xb | 900 | 40.2 | 33.5 | (5.9 | 2.4 | 3.52 | 0.378 | 1.331 | 0.284 | 1.068 | 1.745 | Good |
| | | 1050 | 99.5 | 0.0 | 0.1 | 0.4 | 0.53 | 0.471 | 1.253 | 0.376 | 1.908 | 0.985 | Bad |
| | Xc | 900 | 2.7 | 21.5 | 75.0 | 0.C | 4.04 | 0.394 | 1.215 | 0.325 | 1.005 | 1.957 | Bad |
| | | 1050 | 3.5 | 42.6 | 52.3 | 1.6 | 4.78 | 0.412 | 1.204 | 0.342 | 1.914 | 2.687 | Bad |
| | Xd | 900 | 75.2 | 16.5 | 7.1 | 1.2 | 3.64 | 0.373 | 1.327 | 0.281 | 1.058 | 1.736 | Good |
| | | 1050 | 90.3 | 0.4 | 0.0 | 0.5 | 1.34 | 0.592 | 1.663 | 0.352 | 1.724 | 2.386 | Bad |
| | Xe | 900 | 32.5 | 65.4 | 2.2 | 0.0 | 2.53 | 0.385 | 1.347 | 0.286 | 1.055 | 1.734 | Good |
| | | 1050 | 99.6 | 0.3 | 0.1 | 0.0 | 0.37 | 0.020 | >2.0 | — | 1.514 | 2.676 | Bad |
| | Xf | 900 | 90.7 | 0.0 | 0.4 | 0.9 | 0.68 | 0.481 | 1.217 | 0.395 | 1.902 | 2.254 | Bad |
| | | 1050 | 90.9 | 0.0 | 0.2 | 0.0 | 0.53 | 0.467 | 1.223 | 0.382 | 1.094 | 2.183 | Bad |
| | Xg | 900 | 11.7 | 36.1 | 40.0 | 3.4 | 5.03 | 0.401 | 1.186 | 0.338 | 1.904 | 2.074 | Bad |
| | | 1050 | 22.4 | 1.9 | 17.3 | 50.4 | 15.6 | 0.399 | 1.203 | 0.332 | 1.007 | 2.023 | Bad |
| | Xh | 900 | 1.2 | 14.2 | 60.9 | 15.7 | 0.52 | 0.412 | 1.184 | 0.348 | 1.005 | 2.146 | Bad |
| | | 1050 | 2.3 | 19.6 | 0.0 | 70.1 | 13.0 | 0.416 | 1.205 | 0.345 | 1.914 | 2.154 | Bad |
| | Xi | 900 | 6.1 | 12.1 | 50.6 | 23.2 | 9.73 | 0.396 | 1.187 | 0.334 | 1.009 | 2.095 | Bad |
| | | 1050 | 0.0 | 23.5 | 15.4 | 52.3 | 12.3 | 0.412 | 1.195 | 0.345 | 1.923 | 2.163 | Bad |
| | Xj | 900 | 2.9 | 6.3 | 72.5 | 10.3 | 0.46 | 0.400 | 1.212 | 0.330 | 1.009 | 2.016 | Bad |
| | | 1050 | 3.2 | 3.4 | 0.6 | 93.2 | 16.5 | 0.460 | 1.173 | 0.392 | 1.925 | 2.317 | Bad |
| A3 | Xh | 900 | 5.0 | 17.6 | 62.5 | 14.1 | 0.16 | 0.440 | 1.263 | 0.348 | 1.003 | 2.186 | Bad |
| | | 1050 | 0.2 | 2.5 | 1.7 | 95.6 | 15.0 | 0.402 | 1.114 | 0.361 | 1.962 | 2.206 | Bad |

The steel sheet produced by use of a conventional slab (steel symbol A3) and conventional conditions of hot rolling (symbol Xh) and by annealing of the hot-rolled sheet at 1,050° C. shows a large proportion in numbers of coarse crystal grains of above 7 mm in grain diameter as well as a high magnetic flux density $B_8$ of 1.96 T as evidenced by Table 4. The distribution of crystal grain diameters is not variable even upon baking of an insulating coating after finishing annealing. As concerns the iron loss properties, however, the iron loss $W_{17/50}$ in a strong magnetic field was markedly low, whereas the iron loss $W_{10/50}$ in a weak magnetic field was relatively high. Consequently, the ratio of $W_{10/50}/W_{17/50}$ was so great that the iron loss in the EI core was unacceptable.

In contrast to the above steel sheet of the prior art, the product of the present invention (marked as "good" in the column of remarks in Table 4) was low in iron loss in a weak magnetic field, though high in iron loss in a strong magnetic field, and hence had so small a ratio of $W_{10/50}/W_{17/50}$ that the iron loss in the EI core was highly satisfactory. Such product was derived from a slab (steel symbol A1) that fell within the scope of the invention and contained Nb in a trace and Al in a limited amount, which slab was subjected to a slab heating temperature of lower than 1,200° C., a final temperature of hot rolling of below 950° C. (above 800° C.) and a hot-rolled sheet annealing temperature of 900° C.

Observations on the crystal structures are now given which have been based upon examination of the results of Experiment 1. The observations on the Al contents, the hot rolling conditions and the hot-rolled sheet annealing conditions will be described later.

The crystal structure of the product adjudged to be good in Experiment 1 is characteristic of a crystal grain diameter rendered smaller than that derived from the prior art method, that is, of a large proportion of number of crystal grains with a grain diameter of smaller than 4 mm, particularly below 1 mm. Continued experimentation and consideration on that point reveal that the proportion in numbers of crystal grains with a grain diameter smaller than 1 mm is required to be larger than 25%. It has also been revealed that excessive presence of such fine grains produces a great decline of magnetic characteristics with ultimate reduction in the value of $W_{10/50}$. Even in the case where use is made of a slab according to the present invention (steel symbol A1 in Table 4), but the slab is treated at too low or high a final temperature of hot rolling, or at too high an annealing temperature of a hot-rolled sheet and is constructed to have larger than 98% of a proportion in number of crystal grains with a grain diameter of smaller than 1 mm, the value of $W_{10/50}$ and the ratio of $W_{10/50}/W_{17/50}$ as well as the iron loss properties for the EI core are sharply deteriorated. Thus, it is required that the proportion in number of crystal grains with a grain diameter of smaller than 1 mm be controlled in the range of from 25 to 98%.

Importantly, a crystal grain of larger than 1 mm in grain diameter should also be made as fine as possible such that coarse crystal grains are prevented to ensure an optimum distribution of crystal grain diameters.

FIG. 1 graphically shows the relationship between the proportion in numbers of crystal grains with a grain diameter of below 1 mm, the iron loss of the EI core and the iron loss ratio of $W_{10/50}/W_{17/50}$ of the final product. As is apparent from this figure, desired results are attainable in the range of 25 to 98% of a proportion in numbers of crystal grains with a grain diameter of below 1 mm.

Figure 2:
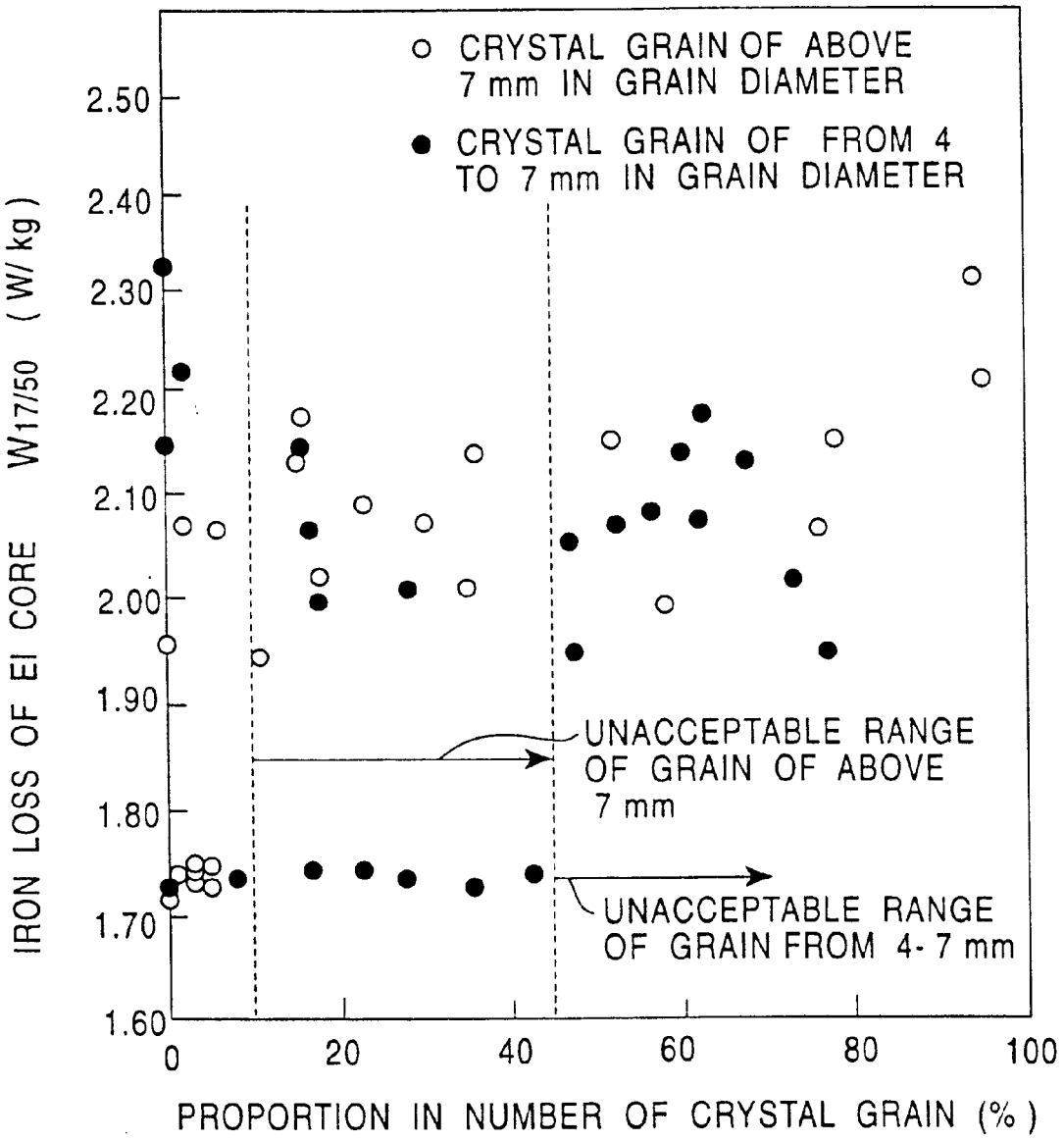
FIG. 2 is a graph representing the relationship between the proportion in number of crystal grains of 4 to 7 mm in grain diameter, the proportion in number of crystal grains of larger than 7 mm in grain diameter and the iron loss of an EI core.

FIG. 2 graphically shows the relationship between the proportion in numbers of crystal grains with a grain diameter of above 4 mm but below 7 mm, the proportion in numbers of crystal grains with a grain diameter of larger than 7 mm and the iron loss of the EI core. This figure shows that both of more than 45% of a proportion in number of crystal grains with a grain diameter of from 1 to 7 mm and more than 10% of a proportion in numbers of crystal grains with a grain diameter of above 7 mm fail to bring about desired iron losses in the EI core.

Experiment 2 was run to examine optimum films of forsterite, and atmospheres for finishing annealing.

Nine slabs of the composition labeled as steel symbol A9 in Table 2 above were hot-rolled under those conditions shown as Xb in Table 3 above, to thereby prepare hot-rolled sheet coils with a sheet thickness of 2.4 mm. At stages from completion of hot rolling to coil winding, cooling was done at a cooling speed of 14.5/sec.

Each of the hot-rolled sheets was annealed at 900° C. for 60 seconds with a temperature rise of 6.5° C./sec, pickled and then warm-rolled to a sheet thickness of 0.34 mm at from 120 to 160° C. by use of a tandem rolling mill, followed by degreasing of the resulting sheet, and by subsequent decarburization-annealing of the same at 850° C. for 2 minutes.

The sheet so treated was then coated with an annealing separator composed as shown in Table 5. Finishing annealing was conducted in a heat pattern in which the annealing temperature was elevated up to 1,180° C. with a temperature rise of 30° C./hr in an atmosphere listed in Table 5, and the sheet was maintained at that temperature for 7 hours, followed by dropping the temperature. Thereafter, unreacted separator was removed.

TABLE 5

| | Annealing separator | | Atmosphere for final finishing annealing ($H_2$ content %, balance $N_2$) | | | | | | | Remark |
|---|---|---|---|---|---|---|---|---|---|---|
| Condition symbol | Content of B in MgO (%) | Amount of $TiO_2$ (%) | Up to 400° C. | 400~650 C. | 650~850° C. | 850~1000° C. | 1000~1180 C. | 1180° C. constant heating | When in temperature | (adaptability to present invention) |
| YA | 0.07 | 3.5 | 0 | 0 | 0 | 0 | 0 | 100 | $H_2$ up to 600° C. and subsequently $N_2$ | Unacceptable |
| YB | | | | 0 | 0 | 0 | 75 | | | Unacceptable |
| YC | | | | 0 | 0 | 75 | 100 | | | Acceptable |
| YD | | | | 0 | 25 | 50 | 75 | | | Acceptable |
| YE | | | | 25 | 50 | 75 | 100 | 100 | | Acceptable |
| YF | 0.02 | 5.5 | | 0 | 25 | 90 | 100 | 100 | | Unacceptable |
| YG | 0.04 | 2.5 | | | | | | | | Acceptable |
| YH | 0.00 | 0 | | | | | | | | Unacceptable |
| YI | 0.12 | 0.0 | | | | | | | | Acceptable |

Disposed over a surface of the steel sheet was a film composed mainly of forsterite ($Mg_2SiO_4$), the latter material having been prepared by reaction, while in finishing annealing, of $SiO_2$ formed on the steel sheet surface at the time of decarburization annealing and MgO as a chief component of the separating agent. Measurement was made of the contents of B, Ti and Al in that film.

The methods of measuring these components are indicated here.

With the forsterite film alone left on the steel sheet surface, the oxygen content (fO), the Al content (fAl), the Ti content (fTi) and the B content (fB) in the steel sheet were analyzed. After removal of the forsterite film by pickling from the steel sheet, analysis was again conducted with respect to the oxygen content (sO), the Al content (sAl), the Ti content (sTi) and the B content (sB) in the steel sheet so pickled.

The coat weight of the forsterite film may be calculated substantially from the following equation:

$$f=(sO-fO)\times Mg_2SiO_4\div O_4=(fO-sO)\times 140.6\div 64$$

Thus, the contents of those elements can be computed as follows:

Al content in film: (fAl-sAl)÷f×100 (%)

Ti content in film: (fTi-sTi)÷f×100 (%)

B content in film: (fB-sB)÷f×100 (%)

After removal of unreacted separator, the steel sheet was coated with an insulating coating composed mainly of magnesium phosphate containing 60% of colloidal silica, followed by baking of the steel sheet at 800° C., whereby a steel sheet product is provided.

In the same manner as in Experiment 1, examination was conducted as to the distribution of crystal grain diameters of and the magnetic characteristics of the steel sheet and as to the iron loss of an EI core produced from the finished steel sheet.

The results are tabulated in Table 6.

by Table 6. This reasoning is thought to flow from the fact that those components would exist in nitride or oxide form, eventually leading to reduced coefficient of thermal expansion of the film as a whole and hence bringing about improved tension.

A nitrogen atmosphere for use in finishing-annealing has an important role to permit such nitride or oxide to be formed in the film. Of particular importance is that the atmosphere for finishing-annealing be highly reductive in the middle to terminal courses of such annealing.

To be more specific, the presence of $H_2$ or a strongly reductive gas in such atmosphere is capable of promoting the decomposition of a nitride in the steel and hence of increasing the content of Al in the film. Simultaneously, the reductive atmosphere acts to facilitate film formation, further increasing the contents of Ti and B in the film. Al does not always need to be added to an annealing separator because such component present in the steel is apt to transfer into the film. In the present invention, therefore, the transfer of Al into the film can be promoted by optimizing the atmosphere for final finishing-annealing and by preventing the component from intruding into unreacted annealing separator.

It has also been found that the components contained in the steel exert important effects on cooling for final finishing annealing in an $N_2$ atmosphere, on baking annealing for insulating coating and on flattening annealing.

Namely, Ti, B and Sb present in the steel have the advantage that they are capable of protecting the steel against adverse nitridation that is likely to occur during annealing in a $N_2$ atmosphere. Ti and B exist in enriched condition at the interface between the base steel and the film thereon, acting to form BN and TiN and hence preventing N from intrusion into the steel (base steel) with ultimate enhancement of film strength. Sb is present in enriched

TABLE 6

| Steel symbol | Condition symbol | Proportion of crystal grain in number (%) Below 1 mm | 1~4 mm | 4~7 mm | Above 7 mm | Average grain diameter (mm) | Content in film (wt %) Al | Ti | B | Iron loss (W/kg) $W_{10/50}$ | $W_{17/50}$ | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|---|---|---|---|
| A9 | YA | 99.5 | 0.0 | 0.2 | 0.3 | 0.04 | 0.05 | 0.03 | 0.03 | 0.583 | >0.2 | — | 1.628 | 2.963 | Bad |
| | YD | 7B.2 | 7.4 | 12.1 | 2.3 | 3.05 | 0.38 | 0.76 | 0.07 | 0.420 | 1.288 | 0.326 | 1.875 | 2.045 | Bad |
| | YC | 62.4 | 35.6 | 2.0 | 0.0 | 1.76 | 1.26 | 1.63 | 0.00 | 0.374 | 1.331 | 0.281 | 1.868 | 1.723 | Good |
| | YD | 65.3 | 33.1 | 1.6 | 0.0 | 1.67 | 4.32 | 2.07 | 0.07 | 3.370 | 1.321 | 0.280 | 1.861 | 1.718 | Good |
| | YE | 76.7 | 21.0 | 1.7 | 0.0 | 1.54 | 6.35 | 1.05 | 0.09 | 0.36B | 1.328 | 0.277 | 1.856 | 1.658 | Good |
| | YF | 71.6 | 26.1 | 2.3 | 0.0 | 1.58 | 5.72 | 3.52 | 0.005 | 0.433 | 1.338 | 0.324 | 1.856 | 1.986 | Back |
| | YG | 69.5 | 26.9 | 3.6 | 0.0 | 1.75 | 5.41 | 0.67 | 0.02 | 0.372 | 1.314 | 0.283 | 1.857 | 1.722 | Good |
| | YH | 70.3 | 27.9 | 1.8 | 0.0 | 1.57 | 5.62 | 0.01 | 0.0B | 0.448 | 1.336 | 0.335 | 1.856 | 1.987 | Bad |
| | YI | 72.5 | 22.9 | 4.6 | 0.0 | 1.68 | 4.36 | 4.52 | 0.24 | 0.365 | 1.322 | 0.276 | 1.857 | 1.654 | Good |

As is evident from Table 6, the distribution of crystal grain diameters is within the scope of the present invention, and the iron loss properties in a weak magnetic field are clearly dependent on the contents of Al, Ti and B in the film. The larger the contents of these components are, the iron loss properties in a weak magnetic field become better. The contents of Al, Ti and B in the film are variable with the contents of the same in the annealing separator and with the atmospheres for finishing annealing.

The optimum films of forsterite and the optimum atmospheres for finishing annealing were observed in view of the results of Experiment 2.

The iron loss in a weak magnetic field is improved is with increased contents of Al, Ti and B in the film as evidenced condition at the interface between the base steel and the film so that it is capable of avoiding nitridation.

As described above, it has been found from the results of Experiment 2 that those components present in the steel, such as Ti, B, Sb and the like, are also effective in annealing of the finished steel sheet, and moreover in producing improved tension of the film and least nitridation so that these components are conducive to reduced iron loss of the end product in a weak magnetic field.

Figure 3:
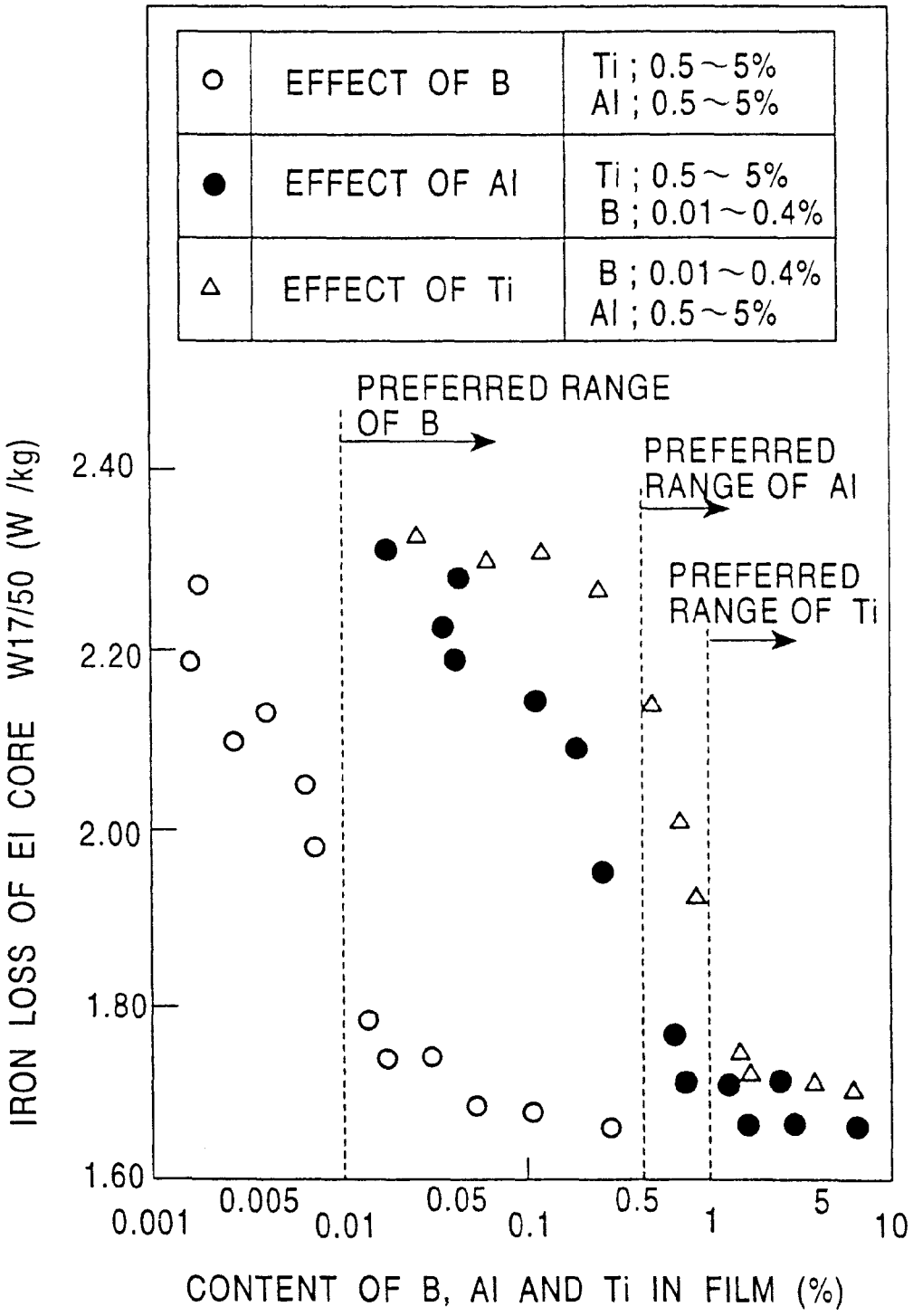
FIG. 3 is a graph representing the relationship between the contents of Al, Ti and B in a forsterite film and the iron loss of an EI core with respect to steel sheets with distributions of crystal grain diameters within the scope of the present invention.

FIG. 3 graphically represents the relationship between the contents of Al, Ti and B in a forsterite film and the iron loss of an EI core with respect to those finished steel sheets tested and proved to meet with the distributions of crystal grain dimensions specified by the present invention. As is apparent from this figure, excellent iron losses for EI cores are feasible only when all of the contents of Al, Ti and B are strictly observed to satisfy the requirements of the invention.

Experiment 3 was run to examine the effects of AlN precipitation nucleating components and the effects of temperature rises for hot-rolled sheet annealing. The experimental method was indicated below.

Six slabs of the composition labeled as steel symbol All in Table 2 above and one slab of the composition labeled as steel symbol A5 in the same table were hot-rolled respectively under those conditions shown as Xb in Table 3 above to thereby prepare hot-rolled sheet coils having a sheet thickness of 2.4 mm. At stages from completion of hot rolling to coil winding, cooling was done at a cooling speed of 26.5/sec.

The hot-rolled sheets were annealed at 900° C. for 60 seconds. In such instance, varying temperature rises of 2.5° C./sec, 3.7° C./sec, 5.4° C./sec, 12.7° C./sec, 23° C./sec and 28° C./sec were employed for the hot-rolled sheets based on the All-slabs and a temperature rise of 12.2° C./sec for the hot-rolled sheet based on the A5-slab.

Thereafter, each of the steel sheets was pickled and warm-rolled to a sheet thickness of 0.34 mm at from 100 to 160° C. by use of a tandem rolling mill, followed by degreasing of the resulting sheet and by subsequent decarburization-annealing of the same at 850° C. for 2 minutes. Coated over the sheet so treated was an annealing separator which had been prepared by adding 7% of $TiO_2$ to MgO containing 0.05% of B. Finishing-annealing was conducted in which the annealing temperature was elevated up to 500° C. in an atmosphere of $N_2$ alone, up to 850° C. in a mixed atmosphere of 25% of $N_2$ and 75% of $H_2$ and up to 1,180° C. in an atmosphere of $H_2$ alone, and the sheet was maintained at the last temperature for 5 hours. After completion of this stage, unreacted separator was removed.

Moreover, an insulating coating was applied which was composed predominantly of magnesium phosphate containing 40% of colloidal silica, and baked at 800° C. provided a steel sheet product.

In the same manner as in Experiment 1, examination was done as to the distribution of crystal grain diameters of and the magnetic characteristics of the steel sheet and as to the iron loss of an EI core produced from the finished steel sheet.

The results of Experiment 3 are tabulated in Table 7.

In regard to a steel sheet product resulting from a slab (steel symbol A5) which lacks the required contents of Ti, Nb, B or Sb in the present invention, the iron losses in both weak and strong magnetic fields were totally unacceptable with too large a proportion of numbers of fine crystal grains smaller than 1 mm in grain diameter, namely above 98%, and with too low a magnetic flux density $B_8$, namely 1.68 T, as is evident from Table 7.

As contrasted to the above product of the prior art, an excellent iron loss in a weak magnetic field and an excellent iron loss in an EI core are attainable with a temperature rise of 5 to 25° C./sec during annealing of a hot-rolled sheet in a steel sheet product derived by use of a slab (steel symbol All) which contains a limited amount of B and falls within the scope of the present invention. Departures from the above specified temperature rises result in impaired iron loss in a weak magnetic field with too large a proportion in numbers, or above 98%, of a fine crystal grains smaller than 1 mm in grain diameter.

Experiments 4 and 5 were run to examine the effects of components and conditions of first finishing hot rolling. The method for Experiment 4 is indicated below.

A slab of the composition labeled as B1 in Table 8 was heated at 1,200° C. into a sheet bar thickness of from 25 to 50 mm by means of rough hot rolling. With the temperature set at 950° C. at an inlet of a finish hot rolling and with cumulative reduction varied at the first 4 passes of finish hot rolling, the sheet bar was subjected to 7 passes of finish hot rolling into a thickness of 2.5 mm. The resulting hot-rolled sheet was annealed at 900° C. for one minute and then cold-rolled to a thickness of 0.34 mm with use of a tandem rolling mill. After degreasing treatment, decarburization annealing was carried out at 850° C. for 2 minutes. In this instance, $P(H_2O)/P(H_2)$ was set at 0.30 in the course of temperature rise and at 0.45 in the course of constant heating. Then, an annealing separator was coated, and finish annealing was done in which the annealing temperature was elevated to from 800 to 1,050° C. in a mixed atmosphere of 25% of $N_2$ and 75% of $H_2$ and to 1,200° C. in an atmosphere of $H_2$ alone, and the coil was maintained at the last temperature for 5 hours. Further, an insulating coating was applied which was composed mainly of magnesium phosphate containing 40% of colloidal silica, and baking was effected at 800° C. to provide a steel sheet product.

TABLE 7

Thickness of Steel sheet: 0.34 mm

| Steel symbol | Temperature rise in annealing temperature of hot-rolled sheet (° C./s) | Proportion of crystal grain in number (%) Below 1 mm | 1~4 mm | 4~7 mm | Above 7 mm | Average grain diameter (mm) | Iron loss (wt %) $W_{10/50}$ | $W_{17/50}$ | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|---|
| A11 | 2.5 | 2.3 | 4.0 | 62.3 | 30.6 | 10.28 | 0.412 | 1.205 | 0.342 | 1.098 | 2.006 | Bad |
| | 3.7 | 12.0 | 29.6 | 47.4 | 10.2 | 5.23 | 0.421 | 1.299 | 0.324 | 1.005 | 1.953 | Bad |
| | 5.4 | 94.5 | 5.1 | 0.4 | 0.0 | 0.73 | 0.393 | 1.384 | 0.284 | 1.063 | 1.758 | Good |
| | 12.7 | 49.3 | 10.0 | 36.1 | 5.6 | 4.63 | 0.381 | 1.384 | 0.275 | 1.064 | 1.718 | Good |
| | 23 | 39.0 | 30.5 | 20.4 | 2.1 | 3.05 | 0.374 | 1.375 | 0.272 | 1.065 | 1.736 | Good |
| | 28 | 0.0 | 4.7 | 59.4 | 35.0 | 9.75 | 0.413 | 1.187 | 0.348 | 1.904 | 2.154 | Bad |
| A5 | 12.2 | 99.6 | 0.0 | 0.3 | 0.1 | 0.44 | 0.654 | '22.0 | — | 1.682 | — | Bad |

TABLE 8

| Steel symbol | Composition (wt %) | | | | | | | | | | | | | | | |
|---|---|---|---|---|---|---|---|---|---|---|---|---|---|---|---|---|
| | C | Si | Mn | P | Al | S | Sn | Cr | Nb | Cu | Mo | B | Ti | N | Sb | Remark |
| B1 | 0.048 | 3.21 | 0.07 | 0.002 | 0.012 | 0.002 | 0.01 | 0.01 | tr | 0.01 | tr | 0.4 | 2 | 75 | 0.010 | Example |
| B2 | 0.053 | 2.95 | 0.06 | 0.004 | 0.004 | 0.002 | 0.01 | 0.01 | tr | 0.01 | tr | 0.0 | 3 | 81 | 0.015 | Comparison Ex. |
| B3 | 0.058 | 3.05 | 0.07 | 0.008 | 0.020 | 0.002 | 0.01 | 0.0I | tr | 0.01 | tr | 0.6 | 3 | 78 | 0.012 | Comparison Ex. |
| B4 | 0.035 | 2.98 | 0.07 | 0.002 | 0.015 | 0.003 | 0.01 | 0.01 | tr | 0.01 | tr | 0.6 | 2 | 72 | tr | Comparison Ex. |
| B5 | 0.039 | 2.96 | 0.07 | 0.004 | 0.013 | 0.004 | 0.01 | 0.01 | tr | 0.01 | tr | 0.7 | 2 | 20 | 0.020 | Comparison Ex. |
| B6 | 0.054 | 3.12 | 0.08 | 0.003 | 0.009 | 0.004 | 0.01 | 0.01 | 50 | 0.01 | tr | 0.4 | 2 | 69 | 0.010 | Example |
| B7 | 0.041 | 3.24 | 0.08 | 0.010 | 0.012 | 0.004 | 0.0I | 0.01 | tr | 0.01 | tr | 3.0 | 4 | 85 | 0.025 | Example |
| B8 | 0.046 | 3.08 | 0.08 | 0.004 | 0.016 | 0.003 | 0.01 | 0.01 | tr | 0.01 | tr | 0.2 | 12 | 88 | 0.042 | Example |
| B9 | 0.065 | 3.01 | 0.07 | 0.007 | 0.015 | 0.003 | 0.0I | 0.01 | tr | 0.0B | tr | 0.4 | 5 | 85 | 0.021 | Example |
| B10 | 0.031 | 2.95 | 0.07 | 0.001 | 0.011 | 0.008 | 0.01 | 0.08 | tr | 0.05 | 0.010 | 0.0 | 2 | 79 | 0.025 | Example |
| B11 | 0.010 | 2.06 | 0.07 | 0.003 | 0.009 | 0.008 | 0.15 | 0.01 | tr | 0.01 | 0.010 | 1.8 | 3 | 76 | 0.018 | Example |
| B12 | 0.025 | 3.21 | 0.06 | 0.008 | 0.011 | 0.003 | 0.01 | 0.01 | 30 | 0.01 | 0.013 | 1.2 | 2 | 83 | 0.021 | Example |
| B13 | 0.034 | 3.15 | 0.06 | 0.005 | 0.014 | 0.004 | 0.01 | 0.01 | 30 | 0.08 | tr | 2.5 | 4 | 82 | 0.040 | Example |

Note: ppm as concerns Nb, B, Ti and N

In the same manner as in Experiment 1, examination was made as to the distribution of crystal grain diameters, the magnetic characteristics of the steel sheet and the iron loss of an EI core produced from the finished steel sheet.

Figure 4:
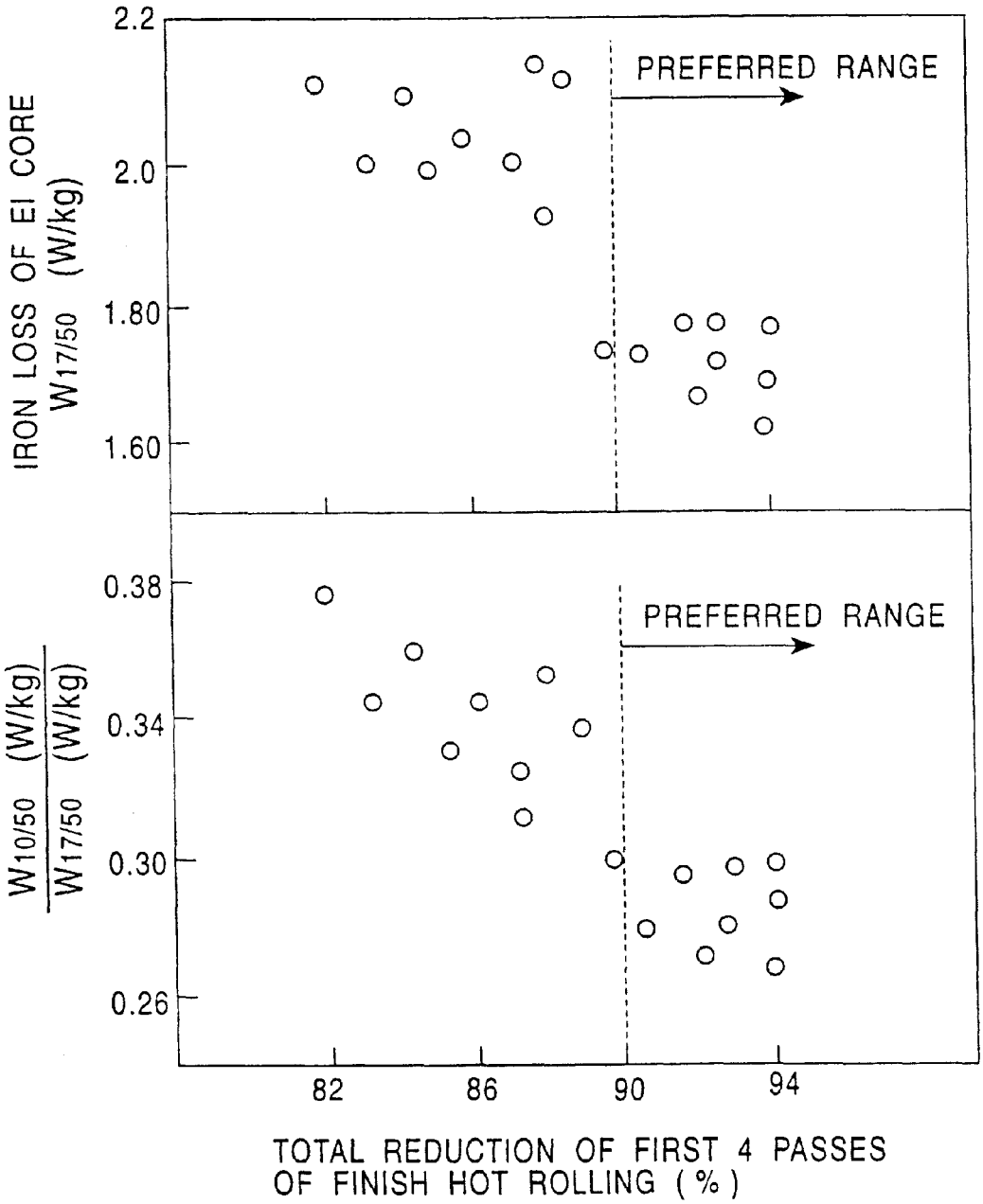
FIG. 4 is a graph representing the relationship between cumulative reduction of the first 4 passes of finish hot-rolling, the $W_{10/50}/W_{17/50}$ ratio of the starting material and $W_{17/50}$ of the resultant EI core.

The product characteristics (Epstein characteristics and EI characteristics) obtained in Experiment 4 are shown in FIG. 4.

When the cumulative reduction of the first 4 passes of finish hot rolling is specified to be higher than 90%, the iron loss in a strong magnetic field is enhanced and that in a weak magnetic field reduced, with a noticeable improvement in EI iron loss as evidenced by FIG. 4. Also characteristically, the resultant steel sheet product has a crystal structure with smaller crystal grain diameters than does the equivalent product arising from the prior art method. The product according to the present invention is abundant in fine crystal grains of smaller than 4 mm in grain diameter, particularly of below 1 mm.

Next, the method used for Experiment 5 and the results obtained therefrom are indicated below.

By use of slabs B1, B3 and B4 listed in Table 8 and also of varying conditions for hot rolling and for hot-rolled sheet annealing, steel sheeting was effected with subsequent steps followed as in Experiment 4. In Table 9, the experiment conditions are tabulated together with the product characteristics.

a specified content of Sb and which satisfies a slab heating temperature (SRT) of lower than 1,250° C., an inlet temperature of finishing rolling (FET) of higher than 900° C., a cumulative reduction of first 4 passes of finish hot rolling of more than 90% and a hot-rolled sheet annealing temperature of 800 to 1,000° C. Both excess Al-containing slab B3 and Sb-free slab B4 failed to bring about acceptable results even after strict observance of the above specified production conditions.

Experiment 6 was run to examine the effects of Al contents and the effects of slab heating temperatures. The method for this experiment is indicated below.

Two pairs of steel slabs were prepared which were designated, respectively, C6 and C10 in Table 10. In each pair, one was heated at 1,200° C. and the other at 1,400° C. Hot rolling was then done to obtain a hot-rolled sheet with a thickness of 2.0 mm. The resulting sheet was divided into two fragments, and one fragment was subjected to annealing at 900° C. for 60 seconds and the other at 1,050° C. for 60 seconds. The two sheets after being pickled were cold rolled at 80° C. to a thickness of 0.34 mm with use of a tandem rolling mill. After degreasing, each such sheet was decarburization-annealed at 830° C. for 2 minutes. Upon coating of an annealing separator on a surface of the sheet, finish annealing was conducted with temperature rises up to 600° C. in an atmosphere of $N_2$ alone, up to 1,050° C. in a mixed atmosphere of 25% of $N_2$ and 75% of $H_2$ and up to 1,200° C. in an atmosphere of $H_2$ alone, and the sheet was maintained at the last temperature for 5 hours. Unreacted separator was then removed.

TABLE 9

| Steel symbol | SRT (° C.) | FET (° C.) | Cumulative reduction of first 4 passes of a finish hot rolling (%) | Temperature of annealing hot-rolled sheet (° C.) | $W_{10/50}$ (W/kg) | $W_{17/50}$ (W/kg) | $W_{10/50}$ / $W_{17/50}$ | $B_8$ (T) | $W_{17/50}$ (EI) (W/kg) | Remark |
|---|---|---|---|---|---|---|---|---|---|---|
| B1 | 1350 | 980 | 90.8 | 900 | 0.53 | 1.51 | 0.351 | 1.72 | 2.37 | Comparison example |
| | 1200 | 980 | 91.2 | 1050 | 0.42 | 1.28 | 0.32B | 1.B7 | 2.19 | Comparison example |
| | 1200 | 940 | 92.0 | 900 | 0.37 | 1.33 | 0.278 | 1.06 | 1.74 | Invention example |
| | 1200 | 970 | 92.3 | 900 | 0.41 | 1.29 | 0.318 | 1.91 | 1.93 | Comparison example |
| | 1200 | 970 | 80.7 | 900 | 0.39 | 1.22 | 0.320 | 1.07 | 2.02 | Comparison example |
| B3 | 1200 | 980 | 90.2 | 900 | 0.39 | 1.19 | 0.328 | 1.09 | 2.14 | Comparison example |
| B4 | 1200 | 975 | 90.5 | 900 | 0.42 | 1.25 | 0.336 | 1.92 | 2.09 | Comparison example |

As is clear from Table 9, a high iron loss in a strong magnetic field and a low iron loss in a weak magnetic field and hence excellent characteristics of an EI core are attainable only in slab B1 which has a decreased content of Al and

TABLE 10

| Steel symbol | Composition (wt %) C | Si | Mn | Al | S | Se | Sb | N | O | Remark | Al/N |
|---|---|---|---|---|---|---|---|---|---|---|---|
| C1 | 0.047 | 2.99 | 0.06 | 0.007 | 0.004 | 0.005 | 0.010 | 0.0070 | 0.0009 | Comparative Ex. | 1.00 |
| C2 | 0.053 | 3.07 | 0.07 | 0.010 | 0.003 | 0.006 | 0.016 | 0.0065 | 0.0010 | Example | 1.54 |
| C3 | 0.042 | 3.13 | 0.07 | 0.013 | 0.005 | 0.008 | 0.015 | 0.0075 | 0.0012 | Example | 1.73 |
| C4 | 0.056 | 3.00 | 0.07 | 0.015 | 0.006 | 0.002 | 0.018 | 0.0060 | 0.0011 | Example | 2.50 |
| C5 | 0.039 | 2.97 | 0.07 | 0.015 | 0.005 | 0.001 | 0.012 | 0.0071 | 0.0010 | Example | 2.11 |
| CG | 0.061 | 3.03 | 0.06 | 0.015 | 0.005 | 0.004 | 0.013 | 0.0078 | 0.0009 | Example | 1.92 |
| C7 | 0.050 | 3.09 | 0.06 | 0.015 | 0.004 | 0.006 | 0.009 | 0.0086 | 0.0009 | Example | 1.74 |
| C8 | 0.044 | 3.01 | 0.07 | 0.015 | 0.007 | 0.005 | 0.017 | 0.0095 | 0.0008 | Example | 1.58 |
| C9 | 0.063 | 3.16 | 0.07 | 0.017 | 0.006 | 0.004 | 0.011 | 0.0085 | 0.0010 | Example | 2.00 |
| C10 | 0.045 | 3.09 | 0.06 | 0.025 | 0.003 | 0.002 | 0.015 | 0.0094 | 0.0011 | Comparative Ex. | 2.66 |

The steel sheet thus prepared was macroetched to inspect the shape of secondary grains. Applied to the steel sheet was an insulating coating composed mainly of magnesium phosphate containing 40% of colloidal silica, and baking was done at 800° C. to provide a steel sheet product. In the same manner as in Experiment 1, examination was made as to the distribution of crystal grain diameters the magnetic characteristics of the steel sheet product and the iron loss of an EI core produced from the finished steel sheet. The results are tabulated in Table 11.

TABLE 11

| Material | Steel | Temperature of slab heating (° C.) | Temperature of annealing hot-rolled sheet (° C.) | Iron loss (W/kg) $W_{10/50}$ (A) | $W_{17/50}$ (B) | A/B | Magnetic flux density $B_8$ (T) | EI core $W_{17/50}$ (W/kg) | Remark |
|---|---|---|---|---|---|---|---|---|---|
| D1 | C6 | 1200 | 900 | 0.370 | 1.288 | 0.287 | 1.068 | 1.733 | Good |
| D2 | | | 1050 | 0.471 | 1.365 | 0.345 | 1.054 | 2.076 | Bad |
| D3 | | 1400 | 900 | 0.425 | 1.333 | 0.319 | 1.057 | 1.958 | Bad |
| D4 | | | 1050 | 0.463 | 1.392 | 0.333 | 1.046 | 2.054 | Bad |
| D5 | C11 | 1200 | 900 | 0.767 | >2.0 | — | 1.622 | 2.513 | Bad |
| D6 | | | 1050 | 0.798 | >2.0 | — | 1.636 | 2.625 | Bad |
| D7 | | 1400 | 900 | 0.499 | 1.299 | 0.384 | 1.075 | 2.166 | Bad |
| D8 | | | 1050 | 0.395 | 1.106 | 0.357 | 1.907 | 2.101 | Bad |

It has been found, as evidenced by Table 11, that only specimen D1 exhibited a low ratio of $W_{10/50}/W_{17/50}$ and an excellent EI core iron loss. On completion of finish annealing and subsequent macroetching, the sheet of specimen D1 became clear from portions defective due to secondary recrystallization and substantially free from coarse crystal grains larger than 7 mm in grain diameter. In the case of slab designated as C11 having Al in a content of 0.025%, secondary recrystallization was impaired by slab heating at 1,200° C. (see specimens D5 and D6), perhaps because AlN did not almost solid-solubilize prior to hot rolling. In contrast, in specimens D7 and D8 using a temperature of 1,400° C. for slab heating, secondary recrystallization was sufficiently achievable with acceptable values of $B_8$ and $W_{17/50}$ but with too large an iron loss of the EI core. Upon inspection of the macrostructures of those specimens, D7 and D8 revealed a coarsened structure with a secondary grain diameter of 20 mm or above. D2 was defective in secondary recrystallization with a secondary grain having a diameter of about 10 mm. D3 and D4 were not defective in secondary recrystallization, the resultant secondary grains being in the order of 10 to 15 mm.

Experiment 6 confirmed that a relatively small content of Al in the slab and a low temperature for slab heating were effective to gain reduced iron loss of an EI core. AlN serves to act as an inhibitor, and Experiment 7 was run to further examine the effects of N contents. The method for this experiment is indicated below.

Each of slabs designated as steel symbols C4 to C8 in Table 10 was heated at 1,150° C., hot-rolled into a hot-rolled sheet with a thickness of 2.4 mm and then subjected to hot rolled sheet annealing at 900° C. for 60 seconds. The sheet after being pickled was rolled to a thickness of 0.34 mm at 150° C. with a tandem rolling mill. After degreasing, the resulting coil was decarburization-annealed at 800° C. for 2 minutes. Upon coating of an annealing separator on a surface of the sheet, final finish annealing was conducted with temperature rises up to 700° C. in an atmosphere of $N_2$ alone, up to 850° C. in a mixed atmosphere of 25% of $N_2$ and 75% of $H_2$ and up to 1,180° C. in an atmosphere of $H_2$ alone, and the sheet was maintained at the last temperature for 5 hours. Unreacted separator was then removed. Applied to the steel sheet was an insulating coating composed mainly of magnesium phosphate containing 60% of colloidal silica, and baked at 800° C. to provide a steel sheet product. In the same manner as in Experiment 1, examination was made as to the distribution of crystal grain diameters, the magnetic characteristics of the steel sheet and the iron loss of an EI core produced from the finished steel sheet. The results are tabulated also in Table 12.

TABLE 12

| Steel | | Iron loss (W/kg) | | | Magnetic flux | EI core | |
|---|---|---|---|---|---|---|---|
| sym-bol | Al/N ratio | $W_{10/50}$ (A) | $W_{17/50}$ (B) | A/B | density $B_8$ (T) | $W_{17/50}$ (W/kg) | Remark |
| C4 | 2.50 | 0.395 | 1.348 | 0.293 | 1.050 | 1.740 | Good |
| C5 | 2.11 | 0.379 | 1.330 | 0.285 | 1.054 | 1.698 | Good |
| C6 | 1.92 | 0.373 | 1.325 | 0.281 | 1.057 | 1.693 | Good |
| C7 | 1.74 | 0.372 | 1.304 | 0.285 | 1.063 | 1.701 | Good |
| C8 | 1.58 | 0.375 | 1.290 | 0.291 | 1.069 | 1.742 | Good |

As is apparent from Table 12, better results are achievable as the value of Al/N is nearer to 27/14 (=1.93), that is, as the atomic ratio of Al to N is nearer to 1:1.

The results obtained from Experiments 1, 3 to 7 will now be reviewed. Namely, the grounds for excellent characteristics of EI core to be attained are summarized by taking into consideration the components of slabs, the conditions for slab heating, the conditions for hot rolling and the conditions for hot-rolled sheet annealing.

A first ground is that the method for precipitating AlN as an inhibitor is novel, and AlN is finely uniformly dispersible to a remarkable extent. Thus, it is thought that secondary recrystallization can be stably effected even in the presence of a crystal grain smaller than 1 mm in grain diameter.

As disclosed in Japanese Examined Patent Publication No. 46-23820 previously cited, a conventional method of precipitation of AlN comprises solid-solubilizing AlN during hot-rolled sheet annealing, reprecipitating AlN in the course of cooling while in hot rolled sheet annealing, and controlling cooling speed at such cooling course to thereby control the size of AlN to be reprecipitated.

In contrast to the above known method, the AlN-precipitating method found to produce desirable results in these experiments is novel in that AlN is maintained in solid-solubilized condition up to hot rolling and then precipitated in the course of temperature rise while in hot-rolled sheet annealing.

The following can be summarized from Experiment 1.

In a method wherein AlN is caused to precipitate in the course of temperature rise while in hot-rolled sheet annealing with AlN maintained in a solid-solubilized state up to hot rolling, the solubility product of AlN needs to be small, thereby precipitating AlN in a particulate state. In such case, it is necessary that the content of Al be rendered smaller than that commonly known as desirable, that the temperature for AlN precipitation be lowered to make AlN less likely to precipitate during hot rolling, and that AlN precipitation be avoided during hot rolling, with the final temperature for hot rolling be set to be above 800° C., and with the temperature for hot-rolled coiling below 670° C. Coiling a hot-rolled sheet at a low temperature accounts for AlN to be prevented from precipitation in a supersaturated condition, which would occur at a high coiling temperature. In order to prevent precipitation of AlN after having undergone hot rolling and having become supersaturated, it is required that the cooling speed be controlled to be high during stages from completion of hot rolling to coil winding. The cooling speed has been found to be necessarily about 10° C./sec or above.

Additionally, hot-rolled sheet annealing at elevated temperature is especially hazardous as at 1,150° C. commonly known for solid-solubilizing AlN. In further preventing the Ostwald ripening of particulate AlN precipitated in the course of temperature rise, annealing temperatures of below about 1,000° C. are appropriate which are too low to have been considered totally unfeasible in the prior art.

The following can be summarized from Experiment 3.

A review of Experiment 3 has shown that there are great differences of distribution of AlN precipitated after temperature rise during hot-rolled sheet annealing. To be more specific, under those conditions (slabs included) which have produced good magnetic characteristics and good distributions of crystal grains, AlN precipitated immediately after temperature rise while in hot rolled sheet annealing are highly densely present in a markedly fine size of 1.0 to 5.0 nm. As against those conditions, in the case where a slab designated as steel symbol A5 is used, or a higher temperature rise of 28° C./sec is employed, AlN fails to precipitate to a sufficient extent. Lower temperature rises of 2.5° C./sec and 3.7° C./sec cause precipitation of AlN in a coarse size of 5.0 to 20 nm. It is thought that varied precipitation of such inhibitor would bring about effects of secondary recrystallization, thus resulting in varied crystal structure of the finished steel sheet.

Consequently, importance is placed on controlling the temperature rises in hot rolled sheet annealing to ensure that AlN shall be precipitated in a fine and dense state. Too low a temperature rise of hot rolled sheet precipitates coarsened AlN. Conversely, too high a temperature rise of hot rolled sheet is responsible for insufficient precipitation of AlN.

To gain controlled precipitation of AlN, importance is placed on, in addition to the temperature rises of hot rolled sheet, the trace components in starting steel slabs and the hot-rolling temperatures. Such components as Ti, Nb, B and Sb have been found to contribute to increased nucleation for AlN precipitation. Ti, Nb and B among these components act to form remarkably fine precipitations during hot finish rolling so that AlN precipitates by forming such fine precipitations as nuclei in the course of temperature rise of hot-rolled sheet annealing. Meanwhile, Sb has proved to segregate at a grain boundary, thus preventing AlN against coarse segregation at such boundary, and increasing the essential concentrations of Al and N both solid-solubilized in the crystal grains with the result that nucleation for AlN precipitation becomes highly frequent.

For that purpose, the final temperature for hot rolling should necessarily be lower than about 970° C. If such final temperature is too high, the above components cannot precipitate even as extremely fine grains that serve as nuclei for AlN precipitation with the consequence that AlN fails to finely uniformly precipitate in the course of temperature rise of hot-rolled sheet annealing.

The following can be summarized from Experiment 4 and Experiment 5.

In Experiments 4 and 5, those methods have been used to precipitate finely divided AlN. That is, the content of Al is made smaller than that conventionally accepted as desirable, thereby reducing the solubility product of AlN and hence decreasing the precipitation temperature of AlN such that AlN is rendered less susceptible to precipitation during hot rolling. Furthermore, the temperature at which to initiate finish hot rolling is controlled to a value above about 900° C. by addition of an Sb component tending to segregate at a grain boundary so that a maximum possible rolling reduction is provided to prevent AlN precipitation during hot rolling. As concerns hot-rolled sheet annealing, a high temperature is rather adverse as at 1,150° C. commonly known for solid-solubilizing AlN. To further prevent the Ostwald ripening of particulate AlN precipitated in the course of temperature rise of hot rolled sheet annealing, annealing temperatures of below about 1,000° C. are appropriate which have been regarded as being too low to be acceptable in the prior art.

Additionally, Sb has been found to be effective in precipitating particulate AlN in such course of temperature rise of hot rolled sheet annealing. This is believed to be probably because Sb segregates at a grain boundary, ultimately preventing AlN precipitation at such grain boundary.

The following can be summarized from Experiment 6 and Experiment 7.

In an ordinary grain-oriented electromagnetic steel sheet in which AlN is used as an inhibitor, Al is larger than N in terms of number of atoms. In fact, good results are obtainable as the ratio Al/N is near 1:1. This is believed to flow from the following: in such ordinary steel sheet, the crystal grains need to be highly convergent on an orientation of {110} <001> so that a limited amount of grains directed very closely to {110} <001> are caused to secondarily recrystallize by increasing the temperature at which to initiate secondary recrystallization. Namely, since a high temperature is used in which AlN becomes completely solid-solubilized and loses its inhibition capability, Al is added in an excessive amount. In the present invention, however, it is required that even if convergence on {110} <001> is somewhat low, a secondary recrystallized grain be coarsened with eventual reduction in iron loss of the EI core. Hence, excess Al is not necessary, but an inhibitor of too low an activity is not desirable. To make full use of the activity of AlN with a relatively small amount of Al, it is desired that Al and N be equivalently contained in terms of respective number of atoms.

To sum up, the mode of controlling precipitation of an inhibitor according to the present invention is comprised of the following unique and surprising concepts and means in combination.

1) Decrease in temperature for AlN precipitation by addition of Al in a small amount with eventual lowering of temperature for slab heating.
2) Addition of an AlN precipitation-nucleating component in a trace, lowering of temperatures for hot finish rolling (controlling of upper and lower limits of finish temperatures for hot finishing-rolling), and controlling of AlN precipitation during hot rolling by controlling the lower limits of cooling speeds at stages from completion of hot rolling to coil winding, and by controlling upper limits of temperatures for coil winding.
3) Controlling of AlN precipitation by addition of Sb as an element capable of segregating at a grain boundary, controlling of temperatures and high-reduction rolling at first stages of finish hot rolling.
4) Controlling of AlN precipitation during hot rolling by controlling Al/N.
5) Precipitation of AlN in fine and uniform conditions by controlling temperature rises during annealing of a hot-rolled sheet.
6) Prevention of coarsened crystal grain by controlling upper limits of temperatures for annealing the hot-rolled sheet, which coarsening tends to arise from solid solubilization and Ostwald ripening of AlN.

A second ground lies in improving a primarily recrystallized structure so as to achieve adequate second recrystallization.

To rapidly grow a secondarily recrystallized grain, it is known that a primarily recrystallized grain to be joined should be desirably rendered uniform and small in respect of size. Additionally, it is well known that increased size and varied size of a primarily recrystallized grain arise from coarsening of crystal grains in a starting steel slab, which coarsening would be caused during hot rolling and cold rolling. At a stage prior to hot rolling, however, slab heating should always be done at an elevated temperature to thereby solid-solubilize an inhibitor, and this entails increased crystal grain diameter in the steel before hot rolling. If the ability of the inhibitor to prevent grain growth is weak, then a primarily recrystallized grain naturally becomes large in its diameter, thus showing a coarse grain diameter as large as 18 to 35 $\mu$m as disclosed for example in Japanese Unexamined Patent Publication No. 6-172861.

In those respects, the conditions under which good iron loss properties have been attained in our foregoing work, i.e., low temperatures of about 1,200° C. for slab heating and low temperatures of about 900° C. for annealing hot-rolled sheets, are taken as optimum for the crystal grains in a steel material to be protected against growth prior to hot rolling and cold rolling and hence for the primarily recrystallized structure to be made fine and uniform.

With further regard to the requirement that the crystal grains in the steel material should be protected against coarsening before hot rolling, the steel after being cast may desirably be rended fine in structure. To this end, for example, a method is preferred in which a hot melt while being cast is electromagnetically stirred to avoid development of a columnar structure. Direct rolling without slab heating is also preferable.

Experiment 8 was run to examine the procedures for cold rolling. The method of this experiment is indicated below.

Four slabs each with composition labeled as steel symbol A8 in Table 2 above were hot-rolled under the conditions Xb shown in Table 3 above to thereby obtain hot-rolled sheet coils each with a sheet thickness of 2.4 mm. At stages from completion of hot rolling to coil winding, the cooling speed was 17.5° C./sec. Each of the steel sheets was annealed at 900° C. for 30 seconds with a temperature rise of 7.8° C./sec, pickled and then cold-rolled to a sheet thickness of 0.34 mm.

Subsequently, a first annealed sheet was warm-rolled in a temperature range of from 120 to 180° C. with use of a tandem rolling mill. A second annealed sheet was rolled in a sheet temperature range of from 50 to 80° C. with use of a tandem rolling mill, while a coolant was being jetted in a large amount on to a surface of the sheet to be rolled. A third annealed sheet was rolled with aging treatment by use of a reverse rolling mill in a temperature range of 150 to 220° C. between rolling passes. A fourth annealed sheet was rolled in a sheet temperature range of from 50 to 80° C. with use of a reverse roller, while a coolant was being jetted in a large amount on to a surface of the sheet to be rolled.

After being degreased, each of the cold-rolled sheets was decarburization-annealed at 850° C. for 2 minutes and coated on its surface with an annealing separator which had been prepared by incorporating 7% of $TiO_2$ in MgO containing 0.05% of B. Finishing-annealing was conducted with temperature rises up to 700° C. in an atmosphere of $N_2$ alone, up to 850° C. in a mixed atmosphere of 25% of $N_2$ and 75% of $H_2$ and up to 1,180° C. in an atmosphere of $H_2$ alone and with the sheet maintained at the last temperature for 5 hours. Unreacted annealing separator was thereafter removed.

An insulating coating was applied to the resulting steel sheet, which coating was composed mainly of magnesium phosphate containing 60% of colloidal silica. Baking at 800° C. gave a steel sheet product.

In the same manner as in Experiment 1, examination was made as to the distribution of crystal grain diameters, the magnetic characteristics of the steel sheet product and the iron loss of an EI core produced from the finished steel sheet.

The results are tabulated in Table 13.

TABLE 13

| Steel symbol | Temperature range of cold rolling | Proportion of crystal grain in number (%) Below 1 mm | 1~4 mm | 4~7 mm | Above 7 mm | Average grain diameter (mm) | Iron loss (W/kg) $W_{10/50}$ | $W_{17/50}$ | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|---|
| | | Thickness of Steel sheet: 0.34 mm | | | | | | | | | | |
| A8 | Tandem 120–180° C. | 78.5 | 9.2 | 12.2 | 0.1 | 2.38 | 0.384 | 1.381 | 0.278 | 1.854 | 1.723 | Good |
| | Tandem 50–80° C. | 33.8 | 38.4 | 22.5 | 5.3 | 4.51 | 0.382 | 1.359 | 0.281 | 1.876 | 1.745 | Good |
| | Reverse 150–220° C. | 99.3 | 0.0 | 0.5 | 0.2 | 0.89 | 0.783 | >2.0 | — | 1.714 | 2.354 | Bad |
| | Reverse 50–80° C. | 0.4 | 35.4 | 28.6 | 35.6 | 9.48 | 0.406 | 1.293 | 0.314 | 1.886 | 2.013 | Bad |

Upon comparison with rolling using a reverse rolling mill, rolling using a tandem rolling mill has produced good results concerning the iron loss of $W_{10/50}$ in a weaker magnetic field, the iron loss ratio of $W_{10/50}/W_{17/50}$ in weaker and stronger magnetic fields and the iron loss of an EI core. This is clear from Table 13. In particular, warm rolling at from 120 to 180° C. has a low ratio of $W_{10/50}/W_{17/50}$, though somewhat high in $W_{10/50}$, and excellent iron loss of an EI core with special distribution of crystal grain diameters.

The results of Experiment 8 are reviewed hereunder.

As is generally known, warm rolling and aging treatment act to change the crystal texture of the steel. They contribute to formation of a crystal grain along an orientation of {110} <001> in primarily recrystallized grains serving as nuclei for secondary recrystallization grains. In this case, it is desired that C be diffused by aging treatment at a rolling pass with use of a reverse rolling mill such as a Sendzimir mill as taught by Japanese Examined Patent Publication No. 54-13846.

Despite such prior teaching, this experiment has revealed that rolling with a tandem rolling mill is effective as against aging treatment between rolling passes. Upon comparison of both modes of rolling, a reverse rolling system invites rather a low velocity of strain during rolling, and moreover, static aging owing to a diffusion phenomenon of C tending necessarily to rearrange on exposure to heat which would generate under the influence of working strain, this latter strain occurring as a result of a relatively long period of time while in rolling pass. In a tandem rolling system, the strain velocity during rolling is relatively high, and the static aging is free due to a considerable short length of time while in rolling pass so that dynamic strain aging takes place since C is rearranged and diffused while in the rolling pass.

From the results of this work, it has been found that the tandem rolling system is superior to the reverse counterpart, tandem rolling at a warm temperature is superior to rolling at a low temperature, and the reverse rolling system is objectionable in respect of aging between rolling passes. This means that though high strain velocity and dynamic aging are effectively useful, static aging is wholly adverse. In the practice of the present invention, therefore, the tandem rolling system should desirably be adopted with a rolling temperature of higher than about 90° C., preferably between above about 120° C. and below about 180° C.

Experiment 9 was run to examine the conditions for decarburization annealing.

A slab labeled as B1 in Table 8 above was heated and then subjected to hot rolling under a set of conditions of 950° C. in FET and 92% in cumulative reduction in the first 4 passes of finish hot rolling. The hot-rolled sheet thus obtained was annealed at 900° C. for one minute, pickled and then cold-rolled to a thickness of 0.34 mm with use of a tandem rolling mill. After degreasing treatment, decarburization annealing was carried out in the different atmospheres shown in Table 14. Upon coating of an annealing separator on the resulting coil, finish annealing was effected with temperature rises up to 800 to 1,050° C. in a mixed atmosphere of 25% of $N_2$ and 75% of $H_2$ and up to 1,200° C. in an atmosphere of $H_2$ alone and with the coil maintained at the last temperature for 5 hours. Applied to the coil was an insulating coating which was composed mainly of magnesium phosphate containing 40% of colloidal silica, and baking at 800° C. gave a steel steel product.

TABLE 14

| No. | P ($H_2O$)/P ($H_2$) (in decarburization annealing) Temperature elevating region | Constant heating region | $W_{10/50}$ (W/Kg) | $W_{17/50}$ (W/Kg) | $(W_{10/50})/(W_{17/50})$ | $B_8$ (T) | $W_{17/50}$ (EI) (W/Kg) | Remark |
|---|---|---|---|---|---|---|---|---|
| 1 | 0.35 | 0.55 | 0.38 | 1.35 | 0.281 | 1.86 | 1.78 | Invention example |
| 2 | 0.05 | 0.45 | 0.36 | 1.34 | 0.269 | 1.86 | 1.81 | Invention example |
| 3 | 0.50 | 0.55 | 0.39 | 1.33 | 0.293 | 1.87 | 1.76 | Invention example |
| 4 | 0.60 | 0.50 | 0.43 | 1.22 | 0.352 | 1.89 | 2.03 | Comparison example |
| 5 | 0.40 | 0.70 | 0.45 | 1.25 | 0.360 | 1.92 | 2.06 | Comparison example |

The resulting product was cut along the rolling direction to prepare a specimen of an Epstein size, followed by strain relief annealing of the specimen at 800° C. for 3 hours. Measurement was made of the iron losses $W_{17/50}$ and $W_{17/50}$ and the magnetic flux density $B_8$.

Additionally, iron cores for use in an EI core were punched out of the steel sheet product and thereafter strain relief annealed to thereby produce an EI core product. The iron loss of such EI core was measured.

The results of Experiment 9 were tabulated also in Table 14.

As is evident from Table 14, it has been found that when the ratio $P(H_2O)/P(H_2)$ is controlled to be greater at a temperature-rising region than at a constant heating region while in decarburization annealing, coupled with a ratio of $P(H_2O)/P(H_2)$ controlled to be less than 0.7, those characteristics attained in a weaker magnetic field are excellent with respect to those of a stronger magnetic field, and moreover, the EI characteristics are excellent.

From the results of Experiment 9, the conditions for decarburization annealing are reviewed hereunder.

The following viewpoint is thought to be the mechanism for improving magnetic characteristics of the steel by optimization of decarburization-annealing conditions.

As described hereinbefore, one important feature of the present invention is that secondary recrystallization is stabilized with a secondary grain of below 1 mm in grain diameter made present by causing AlN as an inhibitor to precipitate in a uniform and fine state in the course of a temperature rise of hot rolled sheet annealing. Hence, if uniformly fine AlN of adequate inhibiting strength is variably or irregularly precipitated at a temperature-rising region during decarburization annealing or finishing annealing, the balance between the primary grain diameter and the inhibiting strength is impaired during secondary recrystallization so that the resultant secondary grain becomes variable in shape in particular with deteriorated characteristics in the weaker magnetic is field.

Atmospheres for decarburization annealing influence the structure of a sub-scale on a steel surface, eventually affecting forsterite formation during finish annealing.

Non-uniform or irregular forsterite formation fails to protect AlN against the atmosphere, thus leading to decomposition of AlN due to follow-up oxidation, or promoted nitridation with the result that AlN is variably distributed, ultimately inviting varied behavior of secondary recrystallization.

In this respect, it is believed that if the atmosphere in the course of temperature rise while in decarburization annealing is rendered less oxidative as contemplated under the present invention, a sub-scale to be formed during temperature rise contributes to enhanced protection of a sub-scale formed during constant heating, thus resulting in the formation of homogeneous forsterite and allowing secondary recrystallization to occur with AlN held in an optimum shape.

Experiment 10 was run to examine the effects of temperatures for annealing hot-rolled sheets and also for decarburization annealing. The method for this experiment was indicated below.

A slab labeled as C6 in Table 10 was heated at 1,200° C. and then hot-rolled to prepare a hot-rolled coil with a thickness of 2.4 mm. This coil was annealed for 60 seconds, pickled and thereafter warm-rolled to a thickness of 0.34 mm at from 100 to 160° C. with use of a tandem rolling mill. After degreasing, decarburization annealing was carried out for 120 seconds. On coating of an annealing separator on the resulting coil, finish annealing was conducted with temperature rises up to 500° C. in an atmosphere of $N_2$, up to 850° C. in a mixed atmosphere of 25% of $N_2$ and 75% of $H_2$ and up to 1,180° C. in an atmosphere of $H_2$ alone and with the coil maintained at the last temperature. After removal of unreacted separator, applied to the coil was an insulating coating which was composed mainly of magnesium phosphate containing 40% of colloidal silica, and baking at 800° C. gave a steel sheet product. Additionally, iron cores for use in an EI core were punched out of the steel sheet product, strain relief annealed, laminated one on another and wound with a copper wire to thereby produce an EI core product.

Figure 5:
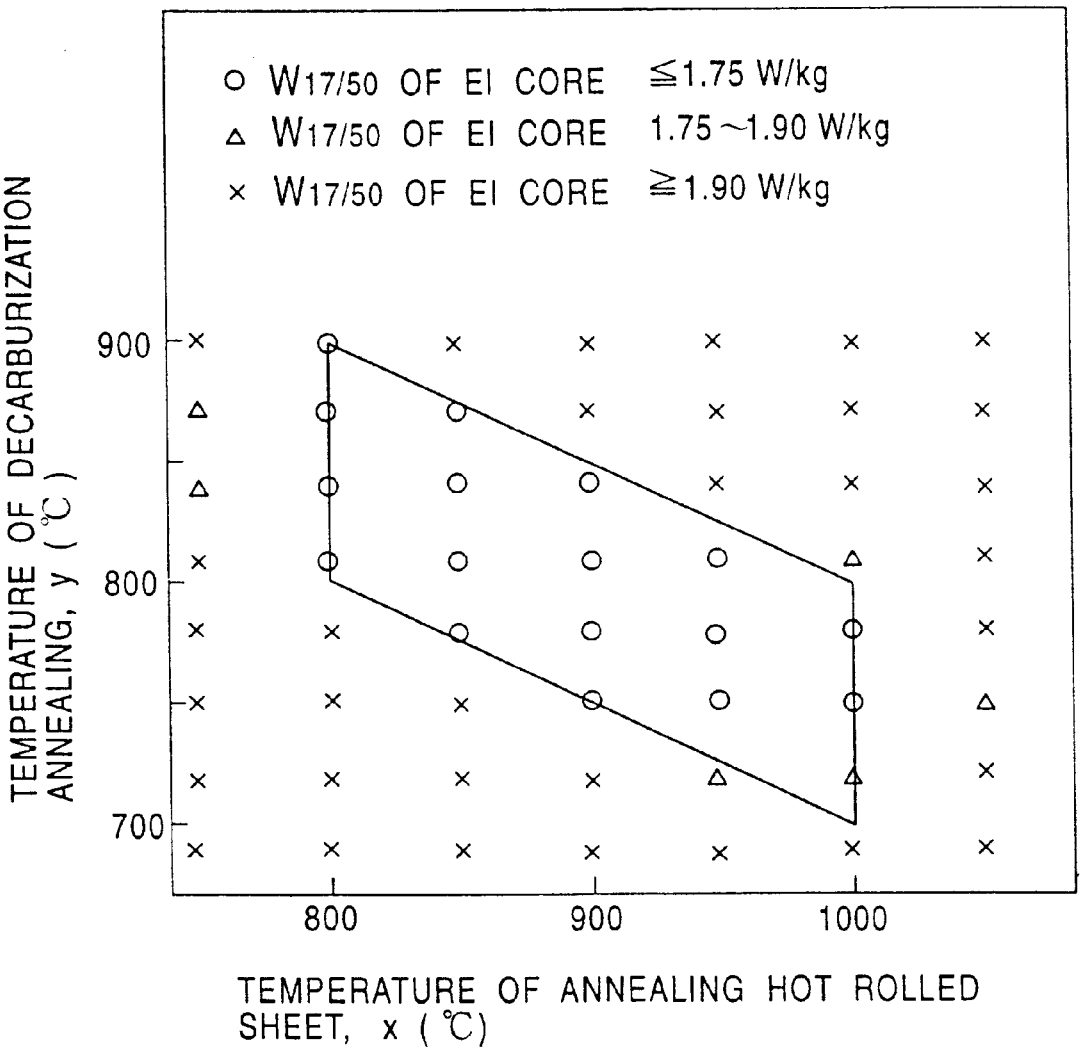
FIG. 5 is a graph representing the effect of the annealing temperature of a hot-rolled sheet and the decarburization-annealing temperature on the iron loss value of an EI core.

The temperature at which to anneal the hot-rolled sheet was varied between 750° C. and 1,050° C. and the temperature at which to effect decarburization annealing varied between 690° C. and 900° C. The iron losses $W_{17/50}$ of the EI core were examined. The results are shown in FIG. 5.

As seen from FIG. 5, the ranges of temperatures substantially preferred for achieving excellent iron losses of the EI core is defined as follows:

$$800 \leqq x \leqq 1{,}000 \text{ and } (-x/2)+1{,}200 \leqq y \leqq (-x/2)+1{,}300$$

x: temperature (° C.) at which to anneal hot-rolled sheet y: temperature (° C.) at which to carry out decarburization annealing The results of Experiment 10 were reviewed. The grain diameter after primary recrystallization became larger with increase of the temperatures for annealing the hot-rolled sheet, and at which to effect decarburization annealing. It is believed necessary to make a secondarily recrystallized grain fine so as to gain reduced iron loss of an EI core. To satisfy this requirement, the primary grain should be carefully controlled. Experiment 10 confirms that the temperature x for annealing a hot-rolled sheet and the temperature y for effecting decarburization annealing should substantially meet with the above defined equations so as to achieve optimum controlling of the primary grain. The temperature range defined by such equations is characteristically lower than that employed to produce a conventional grain oriented electromagnetic steel sheet.

The following description will elucidate the essential and preferable conditions and the related operations which are needed to achieve the advantages of the invention.

Firstly, explanation is provided as to the components, films and grain diameters called for by the grain-oriented electromagnetic steel sheet of this invention.

The grain oriented electromagnetic steel sheet of the present invention should contain the following components as essential or as preferable in some instances.

Si: about 1.5 to 7.0% by weight (hereunder referred to simply as %)

Si is a component effective to enhance the electrical resistance of the finished steel sheet and to reduce the iron loss of the same. For this purpose, the component is added in an amount of more than about 1.5% but of less than about 7.0%. Above about 7.0% renders the steel sheet too highly hard and hence difficult to roll. Hence, the content of Si should be in the range of about 1.5 to 7.0%.

Mn: about 0.03 to 2.5%

Mn leads to increased electrical resistance like Si and also serves to facilitate hot rolling in producing the steel sheet. This component needs to be added in an amount of more than about 0.03% but of less than about about 2.5%. Above 2.5% is responsible for γ transformation and hence for deteriorated magnetic characteristics. Hence, the content of Mn should be in the range of about 0.03 to 2.5%.

Further, it is essential that as impurities C be in a content of less than about 0.003%, preferably of below about 0.001%, and S and N be respectively in contents of less than about 0.002%, preferably of about 0.001%. Failure to observe these specified contents of the impurities exerts adverse effects upon magnetic characteristics, causing poor iron losses in particular.

Where desired, various other components may be used in addition to the above components. Namely, B, Sb, Ge, P, Sn, Cu, Cr, Pb, Zn and In are added as inhibitors, and Mo, Ni and Co as adequately developing secondary recrystallization. These components remain in the resultant steel sheet product. Further addition of Ti and B in trace amounts causes a nitride and an oxide to be formed at an interface between a film and a base steel, thus bringing about a desired effect upon magnetic characteristics in a weak magnetic field.

Here, Sb is particularly desirable since it is capable of preventing the base steel against nitridation during flattening annealing and the like. This component should importantly be added in an amount of not less than about 0.0010%, but more than about 0.080% makes the steel sheet insufficient in toughness and difficult to roll. Hence, the content of Sb should be in the range of about 0.0010 to 0.080%.

The grain oriented electromagnetic steel sheet of the present invention is used with an insulator applied on to its surface, and in this instance, an insulating film is employed which is composed predominantly of forsterite ($Mg_2SiO_4$) and formed during finish annealing. An overcoat may be further applied on the insulating film.

One important feature of the invention lies in controlling trace components contained in the forsterite film. To be more specific, Al, Ti and B should be present in such insulating film. These components impart increased tension to the film, consequently producing improved iron loss in a weak magnetic field of the finished steel sheet. To achieve this advantage, Al should necessarily be added in an amount of not less than about 0.5%, Ti in an amount of not less than about 0.1% and B in an amount of not less than about 0.01%. However, above about 15% of Al, above about 10% of Ti and above about 0.8% of B make the resultant film too hard and hence less adherent. Hence, the content of Al should be in the range of about 0.5 to 15%, the content of Ti in the range of about 0.1 to 10% and the content of B in the range of about 0.01 to 0.8%.

Further explanation is provided as regards the conditions for crystal grains and the related operations required to constitute the grain oriented electromagnetic steel sheet of the present invention.

The crystal grains according to the invention are related to those embedded in the direction of thickness of the steel sheet. The grain diameter is defined as the circle-equivalent diameter, the diameter of a circle having the same area as that of crystal grain on the surface of the steel sheet.

It is necessary that the proportion of numbers of crystal grains below about 1 mm in diameter should be in the range of about 25 to 98%, the proportion of numbers of crystal grains of from about 4 to 7 mm in diameter should be less than about 45% and the proportion of numbers of crystal grains of above about 7 mm in diameter should be less than about 10%.

A crystal grain of above about 7 mm in diameter leads to increased iron loss in a weaker magnetic field other than a stronger magnetic field and hence needs to be less than about 10% in the proportion of numbers, so as to gain improved characteristics of the core Similarly, a crystal grain of from about 4 to 7 mm in diameter needs to be less than about 45% in the proportion of numbers. Increased proportion in numbers of a crystal grain of below about 4 mm in diameter, especially of a crystal grain of below about 1 mm in diameter, is noticeably advantageous in achieving improved iron loss in a weak magnetic field. It is required, therefore, that the proportion of numbers of crystal grains below about 1 mm be not smaller than about 25%. Conversely, above about 98% leads to a rise in iron loss in a weak magnetic field, ultimately resulting in impaired characteristics of the core, and hence, the upper limit should not exceed about 98%.

In order to attain enhanced characteristics of the core by increasing iron loss in a stronger magnetic field and decreasing iron loss in a weaker magnetic field, it is necessary to make such crystal grain diameters fine in a given range. To this end, utmost importance is attached to increasing a crystal grain of below about 4 mm, particularly of a crystal grain of below about 1 mm.

With the crystal grain dimensions controlled and also with the contents of Al, Ti and B in the insulating film restricted essentially as mentioned above, it is feasible to provide a product with excellent iron loss characteristics in a weaker magnetic field relative to a stronger magnetic field.

The process of the present invention will now be described with reference to producing a grain-oriented electromagnetic steel sheet which offers enhanced iron loss characteristics in a weaker magnetic field relative to a stronger magnetic field. Explanation provides those requirements relating to slab compositions, hot-rolling conditions, annealing conditions of hot-rolled sheets, cold-rolling conditions, annealing separator and other parameters as well as modified conditions and the grounds therefor.

Firstly, the slab compositions are explained.

C: about 0.005 to 0.070%

The content of C should be about 0.070% in its upper limit. Above about 0.070% is responsible for excess amount of γ transformation and hence for irregular distribution of Al during hot rolling. This entails non-uniform distribution of precipitated AlN in the course of temperature rise while annealing a hot-rolled sheet, thus failing to afford excellent magnetic characteristics in a weaker magnetic field. The content of C should be about 0.005% at its lower limit. Below about 0.005% is ineffective in improving the resultant slab structure with insufficient secondary recrystallization and hence diminished magnetic characteristics. Hence, the content of C should be in the range of about 0.005 to 0.070%.

Si: about 1.5 to 7.0%

Si gives rise to increased electrical resistance and acts as an essential component to bring about decreased iron loss. To obtain this advantage, Si should be added in a content of not smaller than about 1.5%, but above about 7.0% involves poor workability, thus making the resulting product very difficult to roll. Hence, the content of Si should be in the range of about 1.5 to 7.0%.

Mn: about 0.03 to 2.5%

Mn increases electrical resistance like Si and needs to be added to improve hot rolling among process steps. To achieve such advantage, Mn should be added in a content of below about 0.03%, but above about 2.5% leads to γ transformation eventually resulting in impaired magnetic characteristics. Hence, the content of Mn should be in the range of about 0.03 to 2.5%.

It is required that, in addition to the above components, inhibitor components be incorporated in the finished steel sheet so as to ensure sufficient secondary recrystallization. As the inhibitors, Al and N should be used.

Al: about 0.005 to 0.017%

Below about 0.005% of Al is not sufficient in forming an ample amount of AlN to be precipitated in the course of temperature rise during annealing of a hot-rolled sheet. Inversely, above about 0.017% renders AlN difficult to solid-solubilize during slab heating at a low temperature in the order of about 1,200° C. with eventual rise in solid-solubilization temperature of AlN and hence undesirable precipitation of AlN during hot rolling. This means that AlN cannot be precipitated in a fine state during annealing of the hot-rolled sheet, and as a consequence, desirable iron loss characteristics cannot be obtained in a weaker magnetic field. If slab heating is effected at a high temperature of about 1,400° C. in order to obviate such drawback, the crystal grain diameters of the resulting steel sheet become coarsened, thus causing decreased iron loss in a stronger magnetic field and increased iron loss in a weaker magnetic field with ultimate deterioration of iron loss of the core. Hence, the content of Al should be in the range of about 0.005 to 0.017%.

N: about 0.0030 to 0.0100%

N constitutes a component of AlN and needs to be added in a content of not smaller than about 0.0030%. N in a content of larger than about 0.0100% becomes gasified in the finished steel, eventually leading to such defects as blistering. Hence, the content of N should be in the range of about 0.0030 to 0.0100%.

Al/N: about 1.67 to 2.18

Desirably, the atomic ratio of Al to N should be near 1:1, i.e., the weight ratio of Al to N should be in the range of about 1.67 to 2.18, in which inhibiting effectiveness is well obtainable.

Ti, Nb, B and Sb

In the practice of the present invention, one or more components selected from the group consisting of Ti, Nb, S and Sb should be present.

These components form fine precipitates during hot rolling, which precipitates serve to increase nuclei for precipitation of AlN at a subsequent stage or annealing the hot-rolled sheet. To this end, the content of Ti should be larger than about 0.0005%, the content of Nb larger than about 0.0010%, the content of B larger than about 0.0001% and the content of Sb larger than about 0.0010%. However, above about 0.0020% of Ti, above about 0.010% of Nb, above about 0.0020% of B and above about 0.080% of Sb should be avoided to preclude deteriorated mechanical properties such as bendability of the finished product. Hence, the content of Ti should be in the range of about 0.0005 to 0.0020%, the content of Nb in the range of about 0.0010 to 0.010%, the content of B in the range of about 0.0001 to 0.0020% and the content of Sb in the range of about 0.0010 to 0.080%.

Sb is particularly useful since it is easy to segregate at a grain boundary and effective for preventing segregation of AlN at that grain boundary. In the case of use of Sb, therefore, it is unnecessary to prevent AlN against precipitation in those steps ranging from a terminal stage of finishing rolling to coil winding. The need for preventing AlN precipitation is rather at an initial stage of finish hot rolling.

Other additive components are not always necessary to produce a grain-oriented electromagnetic steel sheet having excellent characteristics of iron loss in a weaker magnetic field as against a stronger magnetic field. Mo, for example, may be added to gain improved surface quality of the resultant steel sheet, and Bi and Te may also be added where needed. For their activity similar to that of Sb, Sn and Cr may be further added in their respective contents of about 0.0010 to 0.30%.

Applicable production conditions will now be explained.

A steel having the above specified composition is usually subjected to slab heating and then converted to a hot-rolled sheet by means of hot rolling. In accordance with one important requirement of the present invention, the slab heating should be conducted at a temperature of lower than about 1,250° C. Slab heating at more elevated temperatures makes the resulting steel sheet adversely abundant in coarse crystal grains of above about 7 mm in diameter in the distribution of crystal grains, thus inviting increased iron loss in a weaker magnetic field. For those reasons, the temperature of slab heating should be not higher than about 1,250° C. A method has recently been developed which enables direct hot-rolling after continuous casting without involving slab heating. Thus, this method is substantially free of slab temperature rise and hence is of course suitable as a process of the present invention for the production of a grain-oriented electromagnetic steel sheet.

In hot rolling, the final temperature of hot rolling should be in the range of about 800 to 970° C. Use of below about 800° C. invites precipitation of AlN in the steel with eventual deterioration of magnetic characteristics in the resulting steel sheet. Conversely, above about 970° C. is responsible for inadequate quantity and distribution of precipitates as nucleating sites for AlN precipitation in the steel and hence leads to insufficient magnetic characteristics of the steel sheet.

Upon completion of hot rolling, cooling needs to be done at a cooling speed of higher than about 10° C./sec. This is because cooling speeds of below about 10° C./sec involve AlN precipitation while cooling and hence cause poor magnetic characteristics. Moreover, the temperature of coil winding should be not higher than about 670° C., and failure to observe this requirement causes adverse AlN precipitation and insufficient magnetic characteristics.

However, in the case where Sb is used, it is not required that AlN be prevented against precipitation in those steps from a terminal stage of finishing rolling to coil winding. Preventing AlN precipitation is rather necessary at an initial stage of finish hot rolling.

Firstly, the temperature of finish hot rolling at the inlet side should be not lower than about 900° C.

If such temperature of finishing-hot rolling is below about 900° C., then AlN becomes precipitated during finish hot rolling and hence invites deteriorated magnetic characteristics. Thus, the temperature of finishing-hot rolling at an inlet side needs to be above about 900° C.

The cumulative reduction of the first 4 passes of finish hot rolling should be not smaller than about 90%.

Finish hot rolling is effected usually at 4 to 10 passes. In the present invention, the cumulative reduction of the first 4 passes of finish hot rolling is controlled to be above about 90% because AlN does not precipitate. The product has excellent characteristics in a weaker magnetic field.

No particular restriction is imposed upon the temperature (FDT) of finishing hot-rolling at an outlet side. Such temperature is preferred to be higher than about 750° C. since rolling becomes difficult at lower temperatures.

Further, the temperature (CT) of coil winding is not particularly limited. Such temperature is preferred to be higher than about 500° C. since coil winding become difficult at lower temperatures than about 500° C.

With AlN prevented from precipitation during hot rolling as stated above, the hot-rolled coil is annealed. Performing such annealing at a considerably low temperature is unique in the present invention. The preferred conditions of temperatures and times for annealing of the hot-rolled sheet are at a temperature of about 800 to 1,000° C. for a retention time of shorter than about 100 seconds. That is, higher annealing temperatures than about 800° C. or longer times than about 100 seconds lead to coarsened crystal grain in the hot-rolled sheet, consequently resulting in insufficient secondary recrystallization because of the growth of a primarily recrystallized crystal grain. Lower annealing temperatures than about 800° C. fail to sufficiently precipitate AlN in the course of temperature rise of the hot-rolled sheet.

Besides and importantly, the most novel concept of the present invention lies in allowing AlN to be precipitated during temperature rise of the hot-rolled sheet annealing. In such instance, the temperature rise of hot-rolled sheet annealing should be in the range of about 5 to 25° C./sec. Less than 5° C./sec suffers from precipitation of coarsened AlN with deteriorated magnetic characteristics, whereas more than about 25° C./sec fails to precipitate AlN in an ample amount and likewise invite deteriorated magnetic characteristics.

After annealing of the hot-rolled sheet is completed, cold rolling is effected once to thereby determine final thickness of the cold-rolled sheet. This cold rolling should necessarily be carried out with use of a tandem rolling mill.

By the term "tandem rolling mill" used herein is meant a rolling apparatus in which rollers are continuously disposed to pass a steel sheet in one direction in continuous manner.

Use of a tandem rolling mill prevents adverse static aging which would occur during rolling passage and further gives increased strain velocity with ultimate formation of an adequate rolled texture. Consequently, a primarily recrystallized texture can be improved in such a manner that the growth of a secondarily recrystallized grain is promoted, the nucleation and growth of a fine crystal grain are facilitated, and a crystal grain of below about 1 mm in diameter and a crystal grain of about 1 to 4 mm in diameter are stably formed in the finished product. In such instance, dynamic aging may be applied by elevating the temperature of the steel sheet being rolled, so that good results are further produced. Preferred rolling temperatures range from about 90 to 300° C. in terms of the steel sheet temperature.

In the case of a reverse-type Sendzimir rolling mill, dynamic aging always takes place and invites formation of a primarily recrystallized structure which would fail to adequately grow a secondarily recrystallized grain with the result that the proportion of numbers of crystal grains below 1 mm in grain diameter becomes excessively large, thus causing diminished iron losses both in a weaker magnetic field and in a stronger magnetic field in the steel sheet product, and also poor iron properties of the core.

Additionally, the reduction during cold rolling should be in the range of about 80 to 95%. Smaller reduction than about 80% causes reduced proportion of nnumbers of crystal grains of below about 1 mm in diameter, thus inviting increased iron loss in a weaker magnetic field as against decreased iron loss in a stronger magnetic field with eventual reduction in iron loss properties of the core. Larger reduction than about 95% produce an excessive proportion of numbers of crystal grains of below 1 mm in diameter, thus causing a large iron loss in a weaker magnetic field with inadequate iron loss properties of the core.

In the present invention, decarburization annealing subsequent to cold rolling is also important.

$P(H_2O)/P(H_2)$ in constant heating: below about 0.7

$P(H_2O)/P(H_2)$ in temperature rise: less than that in constant heating

If $P(H_2O)/P(H_2)$ in constant heating is above about 0.7, a glossy, visually attractive grayish, uniform forsterite film is unattainable. Moreover, good magnetic characteristics are not feasible.

If the ratio $P(H_2O)/P(H_2)$ in temperature rise is less than that in constant heating, the forsterite film becomes less protective during finishing annealing, ultimately suffering from varied shape of inhibitors prior to secondary recrystallization. This fails to sufficiently bring about a secondary grain of below about 1 mm in grain diameter, thus resulting in impaired characteristics in a weaker magnetic field.

For the reasons noted above, the ratio $P(H_2O)/P(H_2)$ in temperature rise of decarburization annealing is controlled to be small (preferably about 0.05 or above) as compared to that in constant heating of decarburization annealing which is set to be below about 0.7 (preferably about 0.3 or above).

As set forth in Experiment 11, it is desired that in conducting hot-rolled sheet annealing and decarburization annealing, the temperature x (° C.) of hot-rolled sheet annealing and the temperature y (° C.) of decarburization annealing be set to meet with about the following specific equations.

$$800 \leqq x \leqq 1{,}000 \text{ and } (-x/2)+1{,}200 \leqq y \leqq (-x/2)+1{,}300$$

Upon coating of an annealing separator on to a decarburization-annealed sheet, which separator contains 1 to 20% of Ti compound and 0.04 to 1.0% of B, finish annealing is performed in an $H_2$-containing atmosphere at from at least about 850° C. in the course of temperature rise. Here, nitridation should importantly be avoided as fully as possible with regard to a steel sheet during decarburization annealing and finish annealing.

As the reasons for addition of Ti compound and B in the annealing separator as well as use of an $H_2$-containing atmosphere from at least 850° C., mention may be made of promoting decomposition of AlN, of increasing Ti and B in the forsterite film to be formed during finish annealing, and of enhancing tension of the film to thereby improve iron loss properties in a weaker magnetic field.

To ensure that those advantages be achieved, more than about 1% of a Ti compound and more than about 0.04% of B should be added to annealing separator. Failure to satisfy the lower limits of Ti and B leads to insufficient contents of these components in the resulting film even with atmospheres adjusted in the course of temperature rise during finish annealing so that desired magnetic characteristics are not obtained. Inversely, above about 20% of Ti and above 1.0% of B make the film too hard and less adhesive to the sheet.

Further, if finish annealing is effected in an atmosphere of $N_2$ alone above about 850° C. in the course of temperature rise, AlN encounters delayed decomposition so that Al is not speedily transferred from the base steel to the film formed thereon. This entails delayed film formation, thus failing to aggregate Ti and B in the film and to provide desirable magnetic characteristics.

After completion of finish annealing, insulating coating and baking are effected where needed, also coupled with straightening annealing, so that a desired product is obtained.

EXAMPLE 1

Molten steel of the compositions labeled as from A1 to A15 in Table 2 above were continuously cast while electromagnetically stirred, whereby slabs were prepared. Each of the resulting slabs was hot-rolled under the conditions listed in Table 3 so that a hot-rolled steel coil was obtained with a thickness of 2.4 mm. Rapid cooling of 15.3 to 18.6° C./sec was done at stages from completion of hot rolling to coil winding. Thereafter, the resulting coil was divided into two fragments, one fragment being annealed at 900° C. for 60 seconds and the other at 1,050° C. for 60 seconds. Both of the coils was rolled to a thickness of 0.34 mm at 150° C. with use of a tandem rolling mill.

After degreasing, decarburization annealing was effected at 850° C. for 2 minutes. $P(H_2O)/P(H_2)$ in the course of temperature rise was set at 0.45 and that in the course of constant heating at 0.5. Then, an annealing separator was applied to a surface of the resulting steel sheet, which separator had been derived by adding 7% of $TiO_2$ to MgO containing 0.12% of B. Finish annealing was accomplished with temperature rises up to 500° C. in an atmosphere of $N_2$ alone, up to 1,050° C. in an atmosphere of 25% of $N_2$ and 75% of $H_2$ and up to 1,200° C. in an atmosphere of $H_2$ alone and with the steel sheet maintained for a total period of 5 hours. Unreacted separating agent was removed after finish annealing.

An insulating coating was applied to the steel coil, which coating was composed mainly of magnesium phosphate containing 40% of colloidal silica. Baking at 800° C. gave a steel sheet product.

With regard to the steel sheet having been made free of unreacted separating agent, analysis was made of the content of Al, Ti, B as well as the distribution of crystal grains after macroetching of the steel sheet. The steel sheet product was cut along the rolling direction to thereby prepare a specimen of an Epstein size, which specimen was then strain relief annealed at 300° C. for 3 hours. Measurement was made of the iron losses $W_{10/50}$ and $W_{17/50}$ and the magnetic flux densities $B_8$. Furthermore, materials for making an EI core were punched out of the steel sheet product, strain relief annealed, laminated and coil-wound with a copper wire so that an EI core was produced, and its iron loss characteristics were measured. The results are tabulated in Table 15.

TABLE 15

| Steel symbol | Proportion of crystal grain in number grain in number (%) Below 1 mm | 1~4 mm | 4~7 mm | Above 7 mm | Average grain diameter (mm) | Content in film (wt %) Al | Ti | B | Iron loss (W/kg) $W_{10/50}$ | $W_{17/50}$ | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|---|---|---|
| A1 | 72.3 | 15.2 | 10.4 | 2.1 | 3.14 | 6.21 | 2.52 | 0.12 | 0.385 | 1.314 | 0.296 | 1.874 | 1.753 | Acceptance example |
| A2 | 99.7 | 0.1 | 0.2 | 0.0 | 0.48 | 5.74 | 3.62 | 0.15 | 0.825 | >2.0 | — | 1.612 | 2.568 | Comparison example |
| A3 | 10.8 | 27.2 | 36.7 | 25.3 | 8.37 | 6.38 | 2.76 | 0.12 | 0.463 | 1.341 | 0.345 | 1.905 | 2.075 | Comparison example |
| A4 | 99.8 | 0.0 | 0.0 | 0.2 | 0.42 | 6.07 | 2.88 | 0.13 | 0.449 | 1.203 | 0.373 | 1.910 | 2.230 | Comparison example |
| A5 | 21.3 | 5.7 | 16.8 | 56.2 | 12.6 | 6.12 | 3.15 | 0.09 | 0.413 | 1.207 | 0.342 | 1.913 | 2.084 | Comparison example |
| A6 | 68.2 | 22.7 | 7.7 | 1.4 | 2.73 | 5.83 | 3.18 | 0.14 | 0.378 | 1.321 | 0.286 | 1.865 | 1.714 | Acceptance example |
| A7 | 48.6 | 31.2 | 16.5 | 3.7 | 3.86 | 5.34 | 2.96 | 0.11 | 0.388 | 1.323 | 0.293 | 1.874 | 1.752 | Acceptance example |
| A8 | 73.8 | 18.4 | 5.4 | 2.4 | 2.84 | 6.25 | 3.27 | 0.15 | 0.374 | 1.334 | 0.280 | 1.862 | 1.748 | Acceptance example |
| A9 | 42.5 | 51.3 | 4.0 | 2.2 | 3.12 | 5.89 | 3.05 | 0.12 | 0.382 | 1.341 | 0.285 | 1.856 | 1.714 | Acceptance example |
| A10 | 64.3 | 20.5 | 9.8 | 5.4 | 4.13 | 5.74 | 2.84 | 0.13 | 0.376 | 1.384 | 0.272 | 1.842 | 1.630 | Acceptance example |
| A11 | 30.3 | 66.1 | 3.6 | 0.0 | 2.35 | 6.13 | 3.12 | 0.15 | 0.382 | 1.342 | 0.283 | 1.856 | 1.702 | Acceptance example |
| A12 | 55.7 | 40.5 | 2.1 | 1.7 | 2.58 | 6.22 | 2.93 | 0.12 | 0.383 | 1.380 | 0.278 | 1.848 | 1.661 | Acceptance example |
| A13 | 95.4 | 3.4 | 1.2 | 0.0 | 0.68 | 5.96 | 3.24 | 0.10 | 0.378 | 1.374 | 0.275 | 1.843 | 1.623 | Acceptance example |
| A14 | 89.1 | 7.2 | 3.3 | 0.4 | 1.67 | 5.68 | 3.09 | 0.12 | 0.375 | 1.383 | 0.271 | 1.846 | 1.620 | Acceptance example |
| A15 | 90.6 | 6.4 | 2.8 | 0.2 | 1.42 | 5.83 | 2.94 | 0.13 | 0.374 | 1.352 | 0.277 | 1.855 | 1.658 | Acceptance example |

As is apparent from Table 15, the grain-oriented electromagnetic steel sheet of the present invention is excellent in respect of the ratio of the iron loss in a weaker magnetic field as compared to that in a stronger magnetic field so that an EI core product is attainable with markedly good iron loss properties.

EXAMPLE 2

Molten steel of the compositions labeled as A12 in Table 2 were cast while being electromagnetically stirred with use of a continuous casting apparatus, whereby six slabs were prepared. Each such slab was hot-rolled under the conditions listed as Xb in Table 3 so that a hot-rolled steel coil was obtained with a thickness of 2.4 mm. At stages from completion of hot rolling to coil winding, the cooling speeds were varied to 4.7° C./sec, 8.8° C./sec, 11.6° C./sec, 15.6° C./sec, 26.5° C./sec and 55.8° C./sec. The hot-rolled steel coil was annealed at 900° C. for 30 seconds with a temperature rise set at 12.6° C./sec. The resulting coil was pickled and warm-rolled to a thickness of 0.29 mm at 100 to 160° C. with use of a tandem rolling mill.

After degreasing, decarburization annealing was conducted at 850° C. for 2 minutes. $P(H_2O)/P(H_2)$ in the course of constant heating was set at 0.50. Upon coating of an annealing separator on to a surface of the steel sheet, which separator was composed of MgO containing 0.05% of B and 4% of $TiO_2$, finish annealing was carried out with temperature rises up to 500° C. in an atmosphere of $N_2$ alone, up to 850° C. in a mixed atmosphere of 25% of $N_2$ and 75% of $H_2$ and up to 1,180° C. in an atmosphere of $H_2$ alone and with the steel sheet maintained at the last temperature for 5 hours. Thereafter, unreacted separator was removed. The steel sheet so treated was further coated with an insulating coating which was composed mainly of magnesium phosphate containing 50% of colloidal silica. Baking at 800° C. led to a steel sheet product.

In the same manner as in Example 1, quantitative analysis was done as to the contents of Al, Ti and B in a forsterite film on the steel sheet made free of unreacted separating agent, and examination was made of the distribution of crystal grains, the magnetic characteristics of the steel sheet product and the iron loss of an EI core produced from such steel sheet.

The results are tabulated in Table 16.

TABLE 16

| Steel symbol | Cooling speed to coil winding (° C./s) | Proportion of crystal grain in number (%) Below 1 mm | 4~7 mm | Above 7 mm | Content in film (wt %) Al | Ti | B | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|
| A12 | 4.7 | 99.6 | 0.1 | 0.3 | 5.12 | 2.06 | 0.04 | — | 1.638 | 1.753 | Comparison example |
| | 8.8 | 32.3 | 33.1 | 15.8 | 4.68 | 1.53 | 0.06 | 0.315 | 1.872 | 1.486 | Comparison example |
| | 11.6 | 75.6 | 4.8 | 0.0 | 5.53 | 1.85 | 0.07 | 0.278 | 1.864 | 1.226 | Acceptance example |
| | 15.6 | 77.4 | 6.2 | 0.0 | 4.75 | 2.06 | 0.04 | 0.275 | 1.857 | 1.223 | Acceptance example |
| | 26.5 | 81.6 | 3.4 | 0.0 | 5.23 | 1.36 | 0.05 | 0.273 | 1.859 | 1.213 | Acceptance example |
| | 55.8 | 78.3 | 1.5 | 0.0 | 5.16 | 1.68 | 0.06 | 0.273 | 1.853 | 1.206 | Acceptance example |

The grain-oriented electromagnetic steel sheet, produced with a cooling speed of above about 10° C./sec as specified by the present invention, exhibits a low ratio of iron loss property in a weaker magnetic field to that in a stronger magnetic field and noticeably excellent iron loss properties in the EI core as evidenced by Table 16.

EXAMPLE 3

Molten steel of the composition labeled as A14 in Table 2 above were cast while being electromagnetically stirred to thereby prepare four slabs, and one slab was prepared with electromagnetic stirring omitted. The four slabs made through electromagnetic stirring were hot-rolled into hot-rolled steel coils each of 2.6 mm in thickness under the conditions labeled as Xa, Xb, Xe and Xf in Table 3 above, whereas the slab made without electromagnetic stirring was hot-rolled under the conditions labeled as Xe in Table 3 (sheet thickness: 2.6 mm). Rapid cooling was effected at a speed of from 21.6 to 26.2° C./sec at stages from completion of hot rolling to coil winding. All of those coils were divided into two fragments, one fragment being annealed at 900° C. for 60 seconds and the other at 1,050° C. for 60 seconds. Each such coil after being pickled was warm-rolled to a thickness of 0.26 mm at 120° C. with use of a tandem rolling mill.

After degreasing, decarburization annealing was done at 850° C. for 2 minutes. $P(H_2O)/P(H_2)$ in the course of temperature rise was set at 0.45 and $P(H_2O)/P(H_2)$ in the course of constant heating at 0.50. Upon coating of an annealing separator on to the surface of the steel sheet, which separator was composed of MgO containing 0.1% of B and 5% of $TiO_2$, finish annealing was carried out with temperature rises up to 800° C. in an atmosphere of $N_2$ alone, up to 1,050° C. in a mixed atmosphere of 25% of $N_2$ and 75% of $H_2$ and up to 1,200° C. in an atmosphere of $H_2$ alone and with the steel sheet maintained at the last temperature for 5 hours. Thereafter, unreacted separator was removed. The steel sheet so treated was further coated with an insulating coating which was composed mainly of magnesium phosphate containing 60% of colloidal silica. Baking at 800° C. led to a steel sheet product.

In the same manner as in Example 1, quantitative analysis was done as to the contents of Al, Ti and B in a forsterite film on the steel sheet made free of unreacted separator, and examination was made of the distribution of crystal grains, the magnetic characteristics of the steel sheet product and the iron loss of an EI core produced from such steel sheet product.

The results are tabulated in Table 17.

TABLE 17

| Steel symbol | Application of electro-magnetic stirring | Symbol of hot rolling condition | Temperature of annealing hot-rolled sheet (° C.) | Proportion of crystal grain in number (%) Below 1 mm | 4~7 mm | Above 7 mm | Content in film (wt %) Al | Ti | B | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|---|---|
| A14 | Yes | Xa | 900 | 99.6 | 0.0 | 0.4 | 4.15 | 2.04 | 0.09 | — | 1.654 | 1.847 | Comparison example |
| | | | 1050 | 3.7 | 18.2 | 57.6 | 4.62 | 2.15 | 0.11 | 0.336 | 1.897 | 1.426 | Comparison example |
| | | Xb | 900 | 76.3 | 6.8 | 0.5 | 4.83 | 2.32 | 0.12 | 0.283 | 1.862 | 1.211 | Acceptance example |
| | | | 1050 | 98.5 | 1.2 | 0.5 | 4.57 | 2.64 | 0.10 | 0.348 | 1.763 | 1.386 | Comparison example |
| | No | Xe | 900 | 40.5 | 8.4 | 1.1 | 4.52 | 2.03 | 0.09 | 0.295 | 1.868 | 1.235 | Acceptance example |
| | | | 1050 | 98.7 | 0.3 | 0.6 | 4.43 | 1.94 | 0.11 | — | 1.673 | 1.757 | Comparison example |
| | Yes | Xe | 900 | 68.4 | 3.2 | 0.0 | 4.62 | 2.36 | 0.10 | 0.281 | 1.858 | 1.204 | Acceptance example |
| | | | 1050 | 99.5 | 0.0 | 0.5 | 4.58 | 1.87 | 0.12 | — | 1.603 | 1.835 | Comparison example |
| | | Xf | 900 | 98.8 | 0.0 | 1.2 | 4.05 | 2.24 | 0.10 | 0.363 | 1.906 | 1.526 | Comparison example |
| | | | 1050 | 98.8 | 0.1 | 1.1 | 4.27 | 2.53 | 0.12 | 0.354 | 1.897 | 1.462 | Comparison example |

The grain-oriented electromagnetic steel sheet, produced with a slab heating temperature of below 1,250° C. and a hot-rolled sheet annealing temperature of 900° C. as specified by the present invention, exhibited better low ratio of iron loss property in a weaker magnetic field to that in a stronger magnetic field and noticeably excellent iron loss properties in the resultant EI core as shown in Table 17.

EXAMPLE 4

Molten steel of the composition labeled as A8 in Table 2 above was cast while being electromagnetically stirred with use of a continuous casting apparatus so as to prepare seven slabs. These slabs were hot-rolled under the conditions labeled as Xb in Table 3 to thereby obtain steel sheet coils respectively of (a) 2.0 mm, (b) 2.2 mm, (c) 2.5 mm, (d) 2.7 mm, (e) 3.2 mm, (f) 3.6 mm and (g) 13 mm in thickness. Cooling was done at a speed of 27.5° C./sec at stages from completion of hot rolling to coil winding. The hot-rolled sheet coils were annealed with a temperature rise of 7.8° C./sec at 900° C. for 30 seconds, followed by cold rolling of the same to a thickness of 0.49 mm, respectively. Thus, the cold rolling reduction of coil (a) was 76%, that of coil (b) 78%, that of coil (c) 80%, that of coil (d) 82%, that of coil (e) 85%, that of coil (f) 86% and that of coil (g) 96%. Each such coil was warm-rolled at from 120 to 180° C. with use of a tandem rolling mill.

After degreasing, decarburization annealing was effected at 80° C. for 2 minutes. $P(H_2O)/P(H_2)$ in the course of temperature rise was set at 0.45 and $P(H_2O)/P(H_2)$ in the course of constant heating at 0.50. Upon coating of an annealing separator on to the surface of the steel sheet, which separator was composed of MgO containing 0.08% of B and 7% of $TiO_2$, finish annealing was carried out with temperature rises up to 700° C. in an atmosphere of $N_2$ alone, up to 850° C. in a mixed atmosphere of 25% of $N_2$ and 75% of $H_2$ and up to 1,200° C. in an atmosphere of $H_2$ alone and with the steel sheet maintained at the last temperature for 5 hours. Thereafter, unreacted separator was removed. The steel sheet so treated was further coated with an insulating coating which was composed mainly of magnesium phosphate containing 60% of colloidal silica. Baking at 800° C. led to a steel sheet product.

In the same manner as in Example 1, quantitative analysis was performed as to the contents of Al, Ti and B in the forsterite film on the steel sheet made free of unreacted separator, and examination was made of the distribution of crystal grains, the magnetic characteristics of the finished steel sheet product and the iron loss of an EI core produced from such steel sheet.

The results are tabulated in Table 18.

TABLE 18

| Steel symbol | Cold rolling reduction | Proportion of crystal grain in number (%) Below 1 mm | 4~7 mm | Above 7 mm | Content in film (wt %) Al | Ti | B | Iron loss ratio $W_{10/50}/W_{17/50}$ | Magnetic flux density $B_8$ (T) | EI core $W_{17/50}$ (W/kg) | Remark |
|---|---|---|---|---|---|---|---|---|---|---|---|
| A8 | 76 | 8.7 | 32.7 | 38.5 | 8.24 | 3.13 | 0.09 | 0.372 | 1.874 | 2.67.5 | Comparison example |
| | 78 | 20.3 | 27.4 | 15.6 | 7.86 | 2.96 | 0.09 | 0.364 | 1.862 | 2.465 | Comparison example |

TABLE 18-continued

| Steel symbol | Cold rolling reduction | Proportion of crystal grain in number (%) Below 1 mm | 4~7 mm | Above 7 mm | Content in film (wt %) Al | Ti | B | Iron loss ratio $W_{10/50}$ / $W_{17/50}$ | Magnetic flux density $B_8$ (T) | EI core $W_{17/50}$ (W/kg) | Remark |
|---|---|---|---|---|---|---|---|---|---|---|---|
| | 80 | 55.0 | 11.8 | 0.7 | 7.79 | 2.85 | 0.10 | 0.308 | 1.862 | 1.782 | Acceptance example |
| | 82 | 62.8 | 3.7 | 0.0 | 8.05 | 3.04 | 0.09 | 0.304 | 1.858 | 1.765 | Acceptance example |
| | 85 | 77.5 | 8.6 | 0.0 | 8.09 | 2.76 | 0.11 | 0.312 | 1.861 | 1.742 | Acceptance example |
| | 86 | 83.2 | 9.4 | 0.0 | 7.96 | 2.89 | 0.09 | 0.314 | 1.854 | 1.756 | Acceptance example |
| | 96 | 99.7 | 0.0 | 0.3 | 8.13 | 3.12 | 0.09 | 0.354 | 1.743 | 2.864 | Comparison example |

The grain-oriented electromagnetic steel sheet, produced with a reduction of 80 to 95% during cold rolling as specified by the present invention, exhibited a low ratio of iron loss property in a weaker magnetic field to that in a stronger magnetic field and noticeably excellent iron loss properties in the resultant EI core as shown in Table 18.

EXAMPLE 5

Molten steel of the composition labeled as A1 in Table 2 were cast while being electromagnetically stirred with use of a continuous casting apparatus so as to prepare nine slabs. These slabs were hot-rolled under the conditions labeled as Xb in Table 3 to thereby obtain steel sheet coils of 2.4 mm in thickness. Cooling was done at a speed of 14.5° C./sec at stages from completion of hot rolling to coil winding. These sheet coils were subjected to hot-rolled sheet annealing with a temperature rise of 6.5° C./sec and at a temperature of 900° C. for a period of time of 30 seconds. Each such coil after being pickled was warm-rolled to a thickness of 0.34 mm at from 170 to 220° C. with use of a tandem rolling mill.

After degreasing, decarburization annealing was done at 850° C. for 2 minutes. $P(H_2O)/P(H_2)$ in the course of temperature rise was set at 0.45 and $P(H_2O)/P(H_2)$ in the course of constant heating at 0.50. Subsequently, finish annealing was conducted by use of annealing separator of the compositions shown in Table 5 and annealing atmospheres shown in the same table. Finish annealing was carried out with a heat pattern in which the temperature rise was done at 30° C./sec up to 1,180° C., and the steel sheet was maintained at that temperature for 7 hours with ultimate temperature drop. Thereafter, unreacted separator was removed. The steel sheet so treated was further coated with an insulating coating which was composed mainly of magnesium phosphate containing 60% of colloidal silica. Baking at 800° C. led to a steel sheet product.

In the same manner as in Example 1, quantitative analysis was performed as to the contents of Al, Ti and B in a forsterite film on the steel sheet made free of unreacted separating agent, and examination was made of the distribution of crystal grains, the magnetic characteristics of the steel sheet product and the iron loss of an EI core produced from such steel sheet.

The results are tabulated in Table 19.

TABLE 19

| Steel | Coil symbol | Proportion of crystal grain in number (%) Below 1 mm | 4~7 mm | Above 7 mm | Content in film (wt %) Al | Ti | B | Iron loss ratio $W_{10/50}$/ $W_{17/50}$ | Magnetic flux density $B_8$ (T) | EI core $W_{17/50}$ (W/kg) | Remark |
|---|---|---|---|---|---|---|---|---|---|---|---|
| A1 | YA | 99.6 | 0.2 | 0.2 | 0.25 | 0.08 | 0.02 | — | 1.624 | 2.626 | Comparison Ex. |
| | YB | 75.2 | 14.3 | 2.6 | 0.42 | 0.56 | 0.08 | 0.324 | 1.873 | 1.922 | Comparison Ex. |
| | YC | 58.7 | 3.1 | 0.0 | 2.76 | 2.53 | 0.08 | 0.280 | 1.863 | 1.718 | Acceptance Ex. |
| | YD | 73.2 | 1.4 | 0.0 | 5.73 | 4.05 | 0.07 | 0.276 | 1.864 | 1.716 | Acceptance Ex. |
| | YE | 72.4 | 1.4 | 0.0 | 7.24 | 2.34 | 0.08 | 0.278 | 1.858 | 1.723 | Acceptance Ex. |
| | YF | 69.7 | 1.9 | 0.0 | 8.53 | 2.27 | 0.005 | 0.336 | 1.867 | 1.968 | Comparison Ex. |
| | YG | 7.06 | 2.5 | 0.0 | 11.2 | 0.72 | 0.03 | 0.282 | 1.857 | 1.716 | Acceptance Ex. |
| | YH | 74.9 | 1.2 | 0.0 | 9.34 | 0.01 | 0.09 | 0.332 | 1.853 | 1.938 | Comparison Ex. |
| | YI | 71.4 | 3.6 | 0.0 | 7.95 | 5.08 | 0.18 | 0.279 | 1.857 | 1.725 | Acceptance Ex. |

The grain-oriented electromagnetic steel sheet, produced with the annealing separator and annealing atmosphere as specified by the present invention, exhibited a low ratio of iron loss property in a weaker magnetic field to that in a stronger magnetic field and noticeably excellent iron loss properties in the resultant EI core as evidenced by Table 19.

EXAMPLE 6

Molten steel of the compositions listed as from B1 to B13 in Table 8 were continuously cast while being electromagnetically stirred so as to prepare slabs. Each such slab after being heated at 1,200° C. was converted to a sheet bar of 45 mm in thickness by use of 5 passes of rough hot rolling and thereafter hot-rolled to a thickness of 2.2 mm at a FET of 900° C. during finish hot-rolling of 7 passes. At that time, the cumulative reduction of the first 4 passes of finish hot rolling was set at 93%.

Subsequently, hot-rolled sheet annealing was conducted with a temperature rise of 12.0° C./sec and at 900° C. for one minute, followed by cold rolling of the resulting sheet coil to a thickness of 0.34 mm with use of a tandem rolling mill.

Decarburization annealing was then done at 820° C. with $P(H_2O)/P(H_2)$ set at 0.45 in the course of temperature rise and at 0.50 in the course of constant heating.

Upon coating of an annealing separator on to the surface of the steel sheet, which separator was composed of MgO containing 0.2% of B and 3% of $TiO_2$, finish annealing was carried out with temperature rises up to 700° C. in an atmosphere of $N_2$ alone, up to 950° C. in a mixed atmosphere of 25% of $N_2$ and 75% of $H_2$ and up to 1,100° C. in an atmosphere of $H_2$ alone and with the steel sheet maintained at the last temperature for 5 hours. Thereafter, an insulating coating was applied to provide a steel sheet product. In the same manner as in Example 1, examination was made of the magnetic characteristics of the steel sheet product and the iron loss of an EI core produced from such steel sheet product. The results are tabulated in Table 20.

The grain-oriented electromagnetic steel sheet produced in accordance with the present invention exhibited low ratio of iron loss properties in a weaker magnetic field to that in a stronger magnetic field and excellent iron loss properties in the resultant EI core as evidenced by Table 20.

TABLE 20

| Steel symbol | $W_{10/50}$ (W/Kg) | $W_{17/50}$ (W/Kg) | $(W_{10/50})/(W_{17/50})$ | $B_8$ (T) | $W_{17/50}$ (EI) (W/Kg) | Remark |
|---|---|---|---|---|---|---|
| B1 | 0.38 | 1.34 | 0.284 | 1.86 | 1.78 | Invention example |
| B2 | 0.63 | 1.82 | 0.346 | 1.78 | 2.16 | Comparison example |
| B3 | 0.44 | 1.29 | 0.341 | 1.89 | 2.05 | Comparison example |
| B4 | 0.39 | 1.21 | 0.322 | 1.92 | 2.12 | Comparison example |
| B5 | 0.41 | 1.25 | 0.328 | 1.91 | 2.09 | Comparison example |
| B6 | 0.40 | 1.35 | 0.296 | 1.88 | 1.74 | Invention example |
| B7 | 0.37 | 1.32 | 0.280 | 1.85 | 1.72 | Invention example |
| B8 | 0.40 | 1.35 | 0.296 | 1.86 | 1.69 | Invention example |
| B9 | 0.37 | 1.32 | 0.280 | 1.87 | 1.71 | Invention example |
| B10 | 0.38 | 1.31 | 0.290 | 1.84 | 1.70 | Invention example |
| B11 | 0.36 | 1.26 | 0.286 | 1.85 | 1.70 | Invention example |
| B12 | 0.35 | 1.29 | 0.271 | 1.86 | 1.68 | Invention example |
| B13 | 0.37 | 1.32 | 0.280 | 1.88 | 1.69 | Invention example |

EXAMPLE 7

Molten steel of the composition listed as B8 in Table 8 were continuously cast while being electromagnetically stirred so as to prepare slabs. Each such slab after being heated at 1,230° C. was converted to a sheet bar of 45 mm in thickness by use of 5 passes of rough hot rolling and thereafter hot-rolled to a thickness of 2.1 mm at a FET of 930° C. during finish hot rolling of 6 passes. At that time, use was made of varying cumulative reduction of first 4 passes of finish hot rolling.

The resultant hot-rolled sheet coil was annealed with a temperature rise of 10.5° C./sec and at 900° C. for one minute and then cold-rolled to a thickness of 0.26 mm with use of a tandem rolling mill.

Decarburization annealing was then performed at 820° C. with $_p(H_2O)/PH_2)$ varied in the course of temperature rise and in the course of constant heating.

Upon coating of an annealing separator on a surface of the steel sheet, which separator was composed of MgO containing 0.3% of B and 7% of $TiO_2$, finish annealing was carried out with temperature rises up to 700° C. in an atmosphere of $N_2$ alone, up to 950° C. in a mixed atmosphere of 25% of $N_2$ and 75% of $H_2$ and up to 1,080° C. and with the steel sheet maintained at the last temperature for 5 hours. Thereafter, an insulating coating was applied to provide a steel sheet product. In the same manner as in Example 1, examination was made of the magnetic characteristics of the steel sheet product and the iron loss of an EI core produced from such steel sheet. The results are tabulated in Table 21.

The grain-oriented electromagnetic steel sheet produced in accordance with the present invention exhibits low ratio of iron loss property in a weak magnetic field to that in a strong magnetic field and excellent iron loss properties in the resultant end product as evidenced by Table 21.

TABLE 21

| No. | Total pressurizing at 4 passes at stage before finishing (%) | P $(H_2O)/P(H_2)$ when in decarburization annealing: Temperature elevating region | Constant heating region | $(W_{10/50})/(W_{17/50})$ | $W_{17/50}$ (EI) (W/Kg) | Remark |
|---|---|---|---|---|---|---|
| 1 | 88 | 0.40 | 0.50 | 0.341 | 31.48 | Comparison example |
| 2 | 92.5 | 0.40 | 0.50 | 0.286 | 1.24 | Invention example |
| 3 | 92 | 0.50 | 0.45 | 0.325 | 1.52 | Comparison example |

TABLE 21-continued

| No. | Total pressurizing at 4 passes at stage before finishing (%) | P ($H_2O$)/P ($H_2$) when in decarburization annealing: Temperature elevating region | Constant heating region | ($W_{10/50}$)/($W_{17/50}$) | $W_{17/50}$ (EI) (W/Kg) | Remark |
|---|---|---|---|---|---|---|
| 4 | 92 | 0.50 | 0.70 | 0.318 | 1.61 | Comparison example |
| 5 | 93 | 0.05 | 0.45 | 0.291 | 1.25 | Invention example |

EXAMPLE 8

Molten steel of the composition listed as B6 in Table 8 above were continuously cast while being electromagnetically stirred so as to prepare slabs. Each such slab after being heated at 1,180° C. was converted to a sheet bar of 45 mm in thickness by use of 5 passes of rough hot rolling and thereafter hot-rolled to a thickness of 2.4 mm at a FET of 950° C. during finish hot rolling of 6 passes. At that time, use was made of varying cumulative reduction of the first 4 passes of finish hot rolling. The resultant hot-rolled sheet coil was annealed with a temperature rise of 15.0° C./sec and at 900° C. for one minute and then cold-rolled to a thickness of 0.49 mm with use of a tandem rolling mill.

Decarburization annealing was then performed at 840° C. with $P(H_2O)/P(H_2)$ varied in the course of temperature rise and in the course of constant heating.

Upon coating of an annealing separator on to a surface of the steel sheet, which separator was composed of MgO containing 0.25% of B and 6% of $TiO_2$, finish annealing was carried out with temperature rises up to 500° C. in an atmosphere of $N_2$ alone, up to 1,000° C. in a mixed atmosphere of 25% of $N_2$ and 75% of $H_2$ and up to 1,150° C. and with the steel sheet maintained at the last temperature for 5 hours. Thereafter, an insulating coating was applied to provide a steel sheet product. In the same manner as in Example 1, examination was made of the magnetic characteristics of the steel sheet product and the iron loss of an EI core produced from such steel sheet. The results are tabulated in Table 22.

The grain-oriented electromagnetic steel sheet produced in accordance with the present invention exhibited a low ratio of iron loss property in a weaker magnetic field to that in a stronger magnetic field and excellent iron loss properties in the resultant EI core as evidenced by Table 22.

EXAMPLE 9

Molten steel of the compositions labeled as from C1 to C10 in Table 10 were continuously cast while being electromagnetically stirred to thereby prepare slabs. Each such slab after being heated at 1,200° C. was hot-rolled at an inlet temperature of 950° C. during finish hot rolling and with a cumulative reduction of the first 4 passes of finish hot rolling of 92%, whereby a hot-rolled sheet coil of 2.4 mm in thickness was obtained. The hot-rolled sheet coil was annealed with a temperature rise of 12.5° C. and at 880° C. for 60 seconds. The resulting coil after being pickled was thereafter rolled to a thickness of 0.34 mm at 150° C. with use of a tandem rolling mill. After degreasing, decarburization annealing was effected at 820° C. for 2 minutes with $P(H_2O)/PH_2)$ set at 0.45 in the course of temperature rise and at 0.50 in the course of constant heating. Upon coating of an annealing separator on to a surface of the steel sheet, which separator was composed of MgO containing 0.1% of B and 8% of $TiO_2$, finish annealing was carried out with temperature rises up to 500° C. in an atmosphere of $N_2$ alone, up to 1,050° C. in a mixed atmosphere of 25% of $N_2$ and 75% of $H_2$ and up to 1,200° C. and with the steel sheet maintained at the last temperature for 5 hours. Thereafter, unreacted separating agent was removed. The steel sheet so

TABLE 22

| No. | Cumulative reduction of first 4 passes of finish hot rolling (%) | P ($H_2O$)/P ($H_2$) when in decarburization annealing: Temperature elevating region | Constant heating region | ($W_{10/50}$)/($W_{17/50}$) | $W_{17/50}$ (EI) (W/Kg) | Remark |
|---|---|---|---|---|---|---|
| 1 | 87 | 0.50 | 0.60 | 0.352 | 2.32 | Comparison example |
| 2 | 93 | 0.55 | 0.60 | 0.302 | 1.79 | Invention example |
| 3 | 92 | 0.45 | 0.40 | 0.324 | 2.26 | Comparison example |
| 4 | 93 | 0.45 | 0.70 | 0.319 | 2.34 | Comparison example |
| 5 | 93 | 0.10 | 0.45 | 0.305 | 1.81 | Invention example |

treated was further coated with an insulating coating which was composed mainly of magnesium phosphate containing 40% of colloidal silica. Baking at 800° C. led to a steel sheet product. In the same manner as in Example 1, examination was made of the magnetic characteristics of the steel sheet product and the iron loss of an EI core produced from such steel sheet. The results are tabulated in Table 23. The grain-oriented electromagnetic steel sheet produced in accordance with the present invention exhibited a low ratio of iron loss in a weaker magnetic field to that in a stronger magnetic field and excellent iron loss properties in the resultant EI core as evidenced by Table 21. These characteristics were remarkably excellent in the case of Al/N in the range between above 1.67 and below 2.18.

TABLE 23

| Steel symbol | AI/N (wt %) | AI/N | Iron loss (W/kg) W10/50 (A) | W17/50 (B) | A/B | Magnetic flux density B8 (T) | EI core W17/50 (W/kg) | Remark |
|---|---|---|---|---|---|---|---|---|
| C1 | 0.007 | 1.00 | 0.443 | 1.433 | 0.309 | 1.809 | 1.843 | Comparison Ex. |
| C2 | 0.010 | 1.54 | 0.390 | 1.350 | 0.289 | 1.851 | 1.734 | Invention Ex. |
| C3 | 0.013 | 1.73 | 0.371 | 1.307 | 0.284 | 1.864 | 1.698 | Invention Ex. |
| C4 | 0.015 | 2.50 | 0.387 | 1.348 | 0.287 | 1.853 | 1.730 | Invention Ex. |
| C5 | 0.015 | 2.11 | 0.376 | 1.333 | 0.282 | 1.858 | 1.694 | Invention Ex. |
| C6 | 0.015 | 1.92 | 0.369 | 1.329 | 0.278 | 1.860 | 1.680 | Invention Ex. |
| C7 | 0.015 | 1.74 | 0.370 | 1.320 | 0.280 | 1.861 | 1.695 | Invention Ex. |
| C8 | 0.015 | 1.58 | 0.376 | 1.298 | 0.290 | 1.869 | 1.738 | Invention Ex. |
| C9 | 0.017 | 2.00 | 0.367 | 1.315 | 0.279 | 1.871 | 1.689 | Invention Ex. |
| C10 | 0.025 | 2.66 | 0.792 | >2.0 | — | 1.701 | 2.458 | Comparison Ex. |

EXAMPLE 10

Slabs of the composition labeled as C9 in Table 8 were heated respectively at 1,150° C., 1,200° C., 1,250° C., 1,300° C. and 1,350° C. and then hot-rolled at an inlet temperature of 950° C. during finishing-hot rolling with a cumulative reduction of first 4 passes of finish hot-rolling of 91.5% so that hot-rolled sheet coils were prepared with a thickness of 2.4 mm. Each such coil was then subjected to hot-rolled sheet annealing with a temperature rise of 8.5° C./sec and at 880° C. for 60 seconds. Thereafter, the sheet coil after being pickled was rolled to a thickness of 0.26 mm at 150° C. with use of a tandem rolling mill. Subsequently, after degreasing, decarburization annealing was effected at 800° C. for 2 minutes with $P(H_2O)/P(H_2)$ set at 0.45 in the course of temperature rise and at 0.50 in the course of constant heating. Upon coating of an annealing separator to a surface of the sheet coil, which separator was composed of MgO containing 0.5% of B and 5% of $TiO_2$, finish annealing was carried out with temperature rises up to 500° C. in an atmosphere of $N_2$ alone, up to 1,050° C. in a mixed atmosphere of 25% of $N_2$ and 75% of $H_2$ and up to 1,200° C. in an atmosphere of $H_2$ alone and with the sheet coil maintained at the last temperature for 5 hours. Unreacted separator was thereafter removed. An insulating coating composed of magnesium phosphate containing 40% of colloidal silica was applied, and baking was done at 800° C., whereby a steel sheet product was obtained. In the same manner as in Example 1, examination was made of the magnetic characteristics of the steel sheet product and the iron loss properties of an EI core produced from such steel sheet. The results are tabulated in Table 24. When the slab heating temperature was not higher than 1,250° C., the ratio of the iron loss in a weaker magnetic field to that in a stronger magnetic field was low with eventual enhancement of the iron loss properties in the resultant EI core, as is clear from Table 24.

TABLE 24

| Steel symbol | Temperature of slab heating (C.°) | Iron loss (W/kg) W10/50 (A) | W17/50 (B) | A/B | Magnetic flux density B8 (T) | EI core W17/50 (W/kg) | Remark |
|---|---|---|---|---|---|---|---|
| C9 | 1150 | 0.263 | 0.940 | 0.280 | 1.857 | 1.212 | Invention example |
| | 1200 | 0.260 | 0.933 | 0.279 | 1.861 | 1.204 | Invention example |
| | 1250 | 0.260 | 0.920 | 0.283 | 1.870 | 1.227 | Invention example |
| | 1300 | 0.274 | 0.899 | 0.305 | 1.889 | 1.379 | Comparison example |
| | 1350 | 0.295 | 0.893 | 0.330 | 1.891 | 1.443 | Comparison example |

EXAMPLE 11

Slabs of the composition labeled as C7 in Table 10 were heated at 1,180° C. and then hot-rolled at an inlet temperature of 940° C. during finishing-hot rolling with a cumulative reduction of the first 4 passes of finish hot rolling of 91.5% so that hot-rolled sheet coils were prepared with a thickness of 2.4 mm. Each such coil was then subjected to hot-rolled sheet annealing with a temperature rise of 10.3° C./sec and for 60 seconds. Thereafter, the sheet coil after being pickled was rolled to a thickness of 0.34 mm at 80° C. with use of a tandem rolling mill.

Subsequently, after degreasing, decarburization annealing was effected for 2 minutes with $P(H_2O)/P(H_2)$ set at 0.45 in the course of temperature rise and at 0.50 in the course of constant heating. Upon coating of an annealing separator to a surface of the sheet coil, which separator was composed of MgO containing 0.2% of B and 6% of $TiO_2$, finish annealing was carried out with temperature rises up to 500° C. in an atmosphere of $N_2$ alone, up to 1,050° C. in a mixed atmosphere of 25% of $N_2$ and 75% of $H_2$ and up to 1,200° C. in an atmosphere of $H_2$ alone and with the sheet coil maintained at the last temperature for 5 hours. Unreacted separating agent was thereafter removed. Here, the temperature x° C. for annealing the hot-rolled sheet and the temperature y° C. for decarburization annealing were varied as (x,y) at 11 different sorts of (750, 800), (800, 750), (800, 850), (800, 950), (900, 750), (900, 800), (900, 850), (1,000, 750), (1,000, 800), (1,000, 800) and (1,050, 800). An insulating coating composed of magnesium phosphate containing 40% of colloidal silica was applied, and baking was done at 800° C., whereby a steel sheet product was obtained. In the same manner as in Example 1, examination was made of the magnetic characteristics of the steel sheet product and the iron loss properties of an EI core produced from such steel sheet product. The results are tabulated in Table 25. When the relationship between x and y is defined as $$800x \leqq 1{,}000, \text{ and } (-x/2)+1{,}200 \leqq y \leqq (-x/2)+1{,}000$$

the ratio of the iron loss in a weaker magnetic field to that in a stronger magnetic field was low with eventual enhancement of the iron loss properties in the resultant EI core as is clear from Table 25.

TABLE 25

| Steel symbol | Temperature of annealing hot-rolled sheet (° C.) | Temperature of decarburization annealing (° C.) | Iron loss (W/kg) W10/50 (A) | Iron loss (W/kg) W17/50 (B) | A/B | Magnetic flux density B8 (T) | EI core W17/50 (W/kg) | Remark |
|---|---|---|---|---|---|---|---|---|
| C7 | 750 | 800 | 0.778 | >2.0 | — | 1.654 | 2.499 | Comparison example |
| | 800 | 750 | 0.761 | >2.0 | — | 1.689 | 2.322 | Comparison example |
| | | 850 | 0.390 | 1.350 | 0.289 | 1.852 | 1.736 | Invention example |
| | | 950 | 0.587 | 1.805 | 0.325 | 1.702 | 2.183 | Comparison example |
| | 900 | 750 | 0.386 | 1.344 | 0.287 | 1.851 | 1.735 | Invention example |
| | | 800 | 0.373 | 1.328 | 0.281 | 1.856 | 1.715 | Invention example |
| | | 850 | 0.377 | 1.331 | 0.283 | 1.857 | 1.719 | Invention example |
| | 1000 | 750 | 0.380 | 1.331 | 0.285 | 1.855 | 1.728 | Invention example |
| | | 800 | 0.380 | 1.339 | 0.284 | 1.854 | 1.726 | Invention example |
| | | 850 | 0.457 | 1.466 | 0.312 | 1.804 | 1.933 | Comparison example |
| | 1050 | 800 | 0.467 | 1.475 | 0.317 | 1.807 | 1.942 | Comparison example |

EXAMPLE 12

Molten steel of the composition labeled as C5 in Table 10 were cast while being electromagnetically stirred by use of a continuous casting apparatus so as to prepare seven slabs. These slabs after being heated at 1,230° C. were hot-rolled at an inlet temperature of 980° C. during finish hot rolling and with a cumulative reduction of the first 4 passes of finish hot rolling set at 92% ((a) to (f)) or at 90.5% ((g)) to thereby obtain hot-rolled sheet coils respectively of (a) 2.0 mm, (b) 2.2 mm, (c) 2.5 mm, (d) 2.7 mm, (e) 3.2 mm, (f) 3.6 mm and (g) 13 mm in thickness. Hot-rolled sheet annealing was thereafter conducted with a temperature rise of 15.3° C./sec and at 900° C. for 30 seconds. Such coils after being pickled were cold-rolled to a thickness of 0.49 mm. Thus, the cold rolling reduction of (a) coil was 76%, that of (b) coil 78%, that of (c) coil 80%, that of (d) coil 82%, that of (e) coil 85%, that of (f) coil 86% and that of (g) coil 96%. Cold rolling was done at from 120 to 180° C., and a tandem rolling mill was employed.

Subsequently, after degreasing, decarburization annealing was effected at 840° C. for 2 minutes with $P(H_2O)/P(H_2)$ set at 0.45 in the course of temperature rise and at 0.50 in the course of constant heating. Upon coating of an annealing separator to a surface of the sheet coil, which separator was composed of MgO containing 0.3% of B and 7% of $TiO_2$, finish annealing was carried out with temperature rises up to 700° C. in an atmosphere of $N_2$ alone, up to 850° C. in a mixed atmosphere of 25% of $N_2$ and 75% of $H_2$ and up to 1,200° C. in an atmosphere of $H_2$ alone and with the sheet coil maintained at the last temperature for 5 hours. Unreacted separator was thereafter removed. An insulating coating composed of magnesium phosphate containing 60% of colloidal silica was applied, and baking was done at 800° C., whereby a steel sheet product was obtained. In the same manner as in Example 1, examination was made of the magnetic characteristics of the steel sheet product and the iron loss properties of an EI core produced from such steel sheet. The results are tabulated in Table 26. The grain-oriented electromagnetic steel sheet, produced with a cold rolling reduction of above 80% but below 95% as called for by the present invention, afforded a low ratio of iron loss properties in a weaker magnetic field to that in a stronger magnetic field, and also markedly good iron loss properties in the resultant EI core, as evidenced by Table 26.

TABLE 26

| Steel symbol | Sheet thickness after vapor rolling (mm) | Sheet thickness after cold rolling (mm) | Pressurizing porportion by cold rolling (%) | Iron loss (W/kg) W10/50 (A) | Iron loss (W/kg) W17/50 (B) | A/B | Magnetic flux density B8 (T) | EI core W17/50 (W/kg) | Remark |
|---|---|---|---|---|---|---|---|---|---|
| C5 | 2.0 | 0.49 | 76 | 0.617 | 1.622 | 0.371 | 1.873 | 2.671 | Comparison example |
| | 2.2 | 0.49 | 78 | 0.608 | 1.666 | 0.365 | 1.864 | 2.473 | Comparison example |
| | 2.5 | 0.49 | 80 | 0.512 | 1.670 | 0.307 | 1.862 | 1.785 | Invention example |
| | 2.7 | 0.49 | 82 | 0.511 | 1.680 | 0.304 | 1.859 | 1.770 | Invention example |
| | 3.2 | 0.49 | 85 | 0.522 | 1.681 | 0.311 | 1.860 | 1.745 | Invention example |
| | 3.6 | 0.49 | 86 | 0.531 | 1.679 | 0.316 | 1.857 | 1.757 | Invention example |
| | 13 | 0.49 | 96 | 0.654 | 1.842 | 0.355 | 1.729 | 2.866 | Comparison example |

As described and shown hereinabove, the present invention ensures provision of a grain-oriented electromagnetic steel sheet which offers by far low ratio of iron loss in a weaker magnetic field to that in a stronger magnetic field. Thus, this specific steel sheet leads to end products such as EI cores having remarkable magnetic characteristics. A noticeable reduction in slab heating temperature is possible and hence the inventive process is conducive to great energy savings.

What is claimed is:

1. A process for production of a grain-oriented electromagnetic steel sheet having a low ratio of iron loss in a weaker magnetic field to that in a stronger magnetic field, which comprises:

casting molten steel into a silicon steel slab, said molten steel comprising about, C: 0.005 to 0.070% by weight, Si: 1.5 to 7.0% by weight, Mn: 0.03 to 2.5% by weight, Al: 0.005 to 0.017% by weight and N: 0.0030 to 0.0100% by weight, said molten steel further including at least one member selected from the group consisting of, Ti: about 0.0005 to 0.0020% by weight, Nb: about 0.0010 to 0.010% by weight, B: about 0.0001 to 0.0020% by weight and Sb: about 0.0010 to 0.080% by weight, subjecting said slab to hot rolling by heating at a temperature of lower than about 1,250° C., or to direct hot rolling;

the outlet temperature of finish hot rolling being in the range of about 800 to 970° C., followed by quenching said steel sheet at a cooling speed of above about 10° C./sec and by subsequent winding of said steel sheet in coiled form at a temperature of lower than about 670° C.:

annealing the resultant sheet while said resultant sheet is being maintained at a temperature of about 800 to 1,000° C. for a period of shorter than about 100 seconds with a temperature rise of about 5 to 25° C./sec;

cold-rolling said annealed sheet at a reduction of about 80 to 95% with use of a tandem rolling mill:

decarburization-annealing said cold-rolled sheet with a ratio of partial steam pressure to partial hydrogen pressure ((P(H2O)/P(H2)) below about 0.7 in the course of constant heating and with P(H2O)/P(H2) lower in the course of temperature rise than in said constant heating;

coating an annealing separator on to said decarburization-annealed sheet, said separator containing a Ti compound in an amount of about 1 to 20% by weight and B in an amount of about 0.04 to 1.0% by weight; and subsequently finish annealing said coated sheet while said coated sheet is being subjected to a temperature rise in a hydrogen-containing atmosphere at at least above about 850° C.

2. A process for production of a grain-oriented electromagnetic steel sheet having a low ratio of iron loss in a weaker magnetic field to that in a stronger magnetic field, which comprises:

casting molten steel into a silicon steel slab, said molten steel comprising about:

C: 0.005 to 0.070% by weight,

Si: 1.5 to 7.0% by weight,

Mn: 0.03 to 2.5% by weight,

Al: 0.005 to 0.017% by weight,

N: 0.0030 to 0.0100% by weight and

Sb: 0.0010 to 0.080% by weight, subjecting said slab to hot rolling by heating at a temperature lower than about 1,250° C., or to direct hot rolling;

finish hot rolling being at a temperature higher than about 900° C. at an inlet side and with a cumulative reduction of first 4 of above about 90%;

annealing the resultant sheet while said resultant sheet is being maintained at a temperature of about 800 to 1,000° C. for a period shorter than about 100 seconds with a temperature rise of from about 5 to 25° C./sec;

cold-rolling said annealed sheet at a reduction of about 80 to 95% with use of a tandem rolling mill;

decarburization-annealing said cold-rolled sheet with P(H2O)/P(H2) below 0.7 in the course of constant heating and with a P(H2O)/P(H2) ratio set to be lower in the course of temperature rise than in constant heating;

coating an annealing separator on to said decarburization-annealed sheet, said separator containing a Ti compound in an amount of about 1 to 20% by weight and B in an amount of about 0.04 to 1.0% by weight; and subsequently finish annealing said coated sheet while said coated sheet is being subjected to temperature rise in a hydrogen-containing atmosphere at at least above about 850° C.

3. The process according to claim 1, wherein the ratio of components Al and N of said silicon steel slab is substantially within the equation, $$1.67 \leqq Al/N \leqq 2.18.$$

4. The process according to claim 2, wherein the ratio of components Al and N of said silicon steel slab is substantially within the equation, $$1.67 \leqq Al/N \leqq 2.18.$$

5. The process according to claim 1, wherein the temperature x° C. of annealing said hot-rolled sheet and the temperature y° C. of decarburization annealing are substantially within the equations:

$$800 \leqq x \leqq 1{,}000, \text{ and } (-x/2)+1{,}200 \leqq y \leqq (-x/2)+1{,}300.$$

6. The process according to claim 2, wherein the temperature x° C. of annealing said hot-rolled sheet and the temperature y° C. of decarburization annealing are substantially within the equations:

$$800 \leqq x \leqq 1{,}000, \text{ and } (-x/2)+1{,}200 \leqq y \leqq (-x/2)+1{,}300.$$

7. The process according to claim 1, wherein electromagnetic stirring is conducted during casting of said molten steel.

8. The process according to claim 2, wherein electromagnetic stirring is conducted during casting of said molten steel.

9. The process according to claim 1, wherein said silicon steel slab comprises at least one member selected from the group consisting of:

Cr: 0.0010 to 0.30% by weight, and

Sn: 0.0010 to 0.30% by weight.

10. The process according to claim 1, wherein said silicon steel slab comprises at least one member selected from the group consisting of:

Cr: 0.0010 to 0.30% by weight, and

Sn: 0.0010 to 0.30% by weight.

11. The process according to claim 1, wherein said cold rolling is conducted at a temperature higher than 90° C.

12. The process according to claim 2, wherein said cold rolling is conducted at a temperature higher than 90° C.

13. The process according to claim 1, wherein said cold rolling is conducted at a temperature between above about 120° C. and below about 180° C.

14. The process according to claim 2, wherein said cold rolling is conducted at a temperature between above about 120° C. and below about 180° C.

15. A process for production of a grain-oriented electromagnetic steel sheet having a low ratio of iron loss in a weaker magnetic field to that in a stronger magnetic field, which comprises:

casting molten steel into a silicon steel slab, said molten steel comprising about, C: 0.005 to 0.070% by weight, Si: 1.5 to 7.0% by weight, Mn: 0.03 to 2.5% by weight, Al: 0.005 to 0.017% by weight and N: 0.0030 to 0.0100% by weight, said molten steel further including at least one member selected from the group consisting of, Ti: about 0.0005 to 0.0020% by weight, Nb: about 0.0010 to 0.010% by weight, B: about 0.0001 to 0.0020% by weight and Sb: about 0.0010 to 0.080% by weight, subjecting said slab to hot rolling by heating at a temperature of lower than about 1,250° C., or to direct hot rolling;

the outlet temperature of finish hot rolling being in the range of about 800 to 970° C., followed by quenching said steel sheet at a cooling speed of above about 10° C./sec and by subsequent winding of said steel sheet in coiled form at a temperature of lower than about 670° C.:

annealing the resultant sheet while said resultant sheet is being maintained at a temperature of about 800 to 1,000° C. for a period of shorter than about 100 seconds with a temperature rise of about 5 to 25° C./sec;

cold-rolling said annealed sheet at a reduction of about 80 to 95% with use of a tandem rolling mill:

decarburization-annealing said cold-rolled sheet with a ratio of partial steam pressure to partial hydrogen pressure ((P(H2O)/P(H2)) below about 0.7 in the course of constant heating and with P(H2O)/P(H2) lower in the course of temperature rise than in said constant heating;

coating an annealing separator on to said decarburization-annealed sheet, said separator containing a Ti compound in an amount of about 1 to 20% by weight and B in an amount of about 0.04 to 1.0% by weight; and subsequently finish annealing said coated sheet while said coated sheet is being subjected to a temperature rise and being maintained in a hydrogen-containing atmosphere at at least above about 850° C.

16. A process for production of a grain-oriented electromagnetic steel sheet having a low ratio of iron loss in a weaker magnetic field to that in a stronger magnetic field, which comprises:

casting molten steel into a silicon steel slab, said molten steel comprising about:

C: 0.005 to 0.070% by weight,

Si: 1.5 to 7.0% by weight,

Mn: 0.03 to 2.5% by weight,

Al: 0.005 to 0.017% by weight,

N: 0.0030 to 0.0100% by weight and

Sb: 0.0010 to 0.080% by weight, subjecting said slab to hot rolling by heating at a temperature lower than about 1,250° C., or to direct hot rolling;

finish hot rolling being at a temperature higher than about 900° C. at an inlet side and with a cumulative reduction of first 4 of above about 90%;

annealing the resultant sheet while said resultant sheet is being maintained at a temperature of about 800 to 1,000° C. for a period shorter than about 100 seconds with a temperature rise of from about 5 to 25° C./sec;

cold-rolling said annealed sheet at a reduction of about 80 to 95% with use of a tandem rolling mill;

decarburization-annealing said cold-rolled sheet with P(H2O)/P(H2) below 0.7 in the course of constant heating and with a P(H2O)/P(H2) ratio set to be lower in the course of temperature rise than in constant heating;

coating an annealing separator on to said decarburization-annealed sheet, said separator containing a Ti compound in an amount of about 1 to 20% by weight and B in an amount of about 0.04 to 1.0% by weight; and subsequently finish annealing said coated sheet while said coated sheet is being subjected to temperature rise and being maintained in a hydrogen-containing atmosphere at least above 850° C.

* * * * *

UNITED STATES PATENT AND TRADEMARK OFFICE

CERTIFICATE OF CORRECTION

PATENT NO. : 6,331,215 B1
DATED : December 18, 2001
INVENTOR(S) : Toge et al.

It is certified that error appears in the above-identified patent and that said Letters Patent is hereby corrected as shown below:

Columns 7 and 8,

Table 2, at the subheading "P", at "A5" please change "0.018" to -- 0.010 --
Table 2, at the subheading "Sn", at "Al" please change "881" to -- 0.01 --
Table 2, at the subheading "Cr", at "A10" please change "0.00" to -- 0.08 --
Table 2, at the subheading "Cu", at "A14" please change "0.18" to -- 0.10 --
Table 2, at the subheading "Mo", at "A8" please change "0.018" to -- 0.010 --
Table 2, at the subheading "B", at "A4" please change "0.0" to -- 0.8 --
Table 2, at the subheading "B", at "A11" please change "2.0" to -- 2.8 --
Table 2, at the subheading "O", at "A8" please change "18" to -- 10 --

Columns 9 and 10,

Table 4 - 1, at the subheading "Below 1 mm", at "Xb" please change "40.2" to -- 48.2 --
Table 4 - 1, at the subheading "Below 1 mm", at the second line of "Xd", please change "90.3" to -- 98.3 --
Table 4 - 1, at the subheading "Below 1 mm", at "Xf" please change "90.7" to -- 98.7 --
Table 4 - 1, at the subheading "Below 1 mm", at the second line of "Xf" please change "90.9" to -- 98.9 --
Table 4 - 1, at the subheading "Below 1 mm", at the second line of "Xi" please change "0.0" to -- 8.8 --
Table 4 - 1, at the subheading "Below 1 mm", at "A3" "Xh" please change "5.0" to -- 5.8 --
Table 4. - 1, at the subheading "4-7 mm", at "Xb" please change "(5.9" to -- 15.9 --
Table 4 - 1, at the subheading "4-7 mm", at "Xc" please change "75.0" to -- 75.8 --
Table 4 - 1, at the subheading "4-7 mm", at the second line of "Xd" please change "0.0" to -- 0.8 --
Table 4 - 1, at the subheading "4-7 mm", at "Xg" please change "40.0" to -- 48.8 --
Table 4 - 1, at the subheading "4-7 mm", at the second line of "Xh" please change "60.9" to -- 68.9 --
Table 4 - 1, at the subheading "4-7 mm", at "Xi" please change "50.6" to -- 58.6 --
Table 4 - 1, at the subheading "4-7 mm", at the second line of "Xj" please change "0.6" to -- 0.0 --
Table 4 - 1, at the subheading "Above 7 mm", at "Xc" please change "0.C" to -- 0.0 --
Table 4 - 1, at the subheading "Above 7 mm", at the second line of "Xf" please change "0.0" to -- 0.8 --
Table 4 - 1, at the subheading "Above 7 mm", at the second line of "Xg" please change "50.4" to -- 58.4 --

UNITED STATES PATENT AND TRADEMARK OFFICE

CERTIFICATE OF CORRECTION

It is certified that error appears in the above-identified patent and that said Letters Patent is hereby corrected as shown below:

Columns 9 and 10 (con't),

Table 4 - 1, at the subheading "Above 7 mm", at the second line of "Xh" please change "70.1" to -- 78.1 --

Table 4 - 1, at the subheading "Above 7 mm", at "Xj" please change "10.3" to --18.3--

Table 4 - 1, at the subheading "Average gain diameter (mm)", at "Xc" please change "4.04" to -- 4.84 --

Table 4 - 1, at the subheading "Average gain diameter (mm)", at "Xc" please change "4.04" to -- 4.84 --

Table 4 - 1, at the subheading "Average gain diameter (mm)", at "Xg" please change "5.03" to -- 5.83 --

Table 4 - 1, at the subheading "Average gain diameter (mm)", at the second line of "Xh" please change "13.0" to -- 13.8 --

Table 4 - 1, at the subheading "Average gain diameter (mm)", at "Xj" please change "0.46" to -- 8.46 --

Table 4 - 1, at the subheading "Average gain diameter (mm)", at "A3 Xh" please change "0.16" to -- 8.16 --

Table 4 - 1, at the subheading "Average gain diameter (mm)", at the second line of "A3 Xh" please change "15.0" to -- 15.8 --

Table 4 - 1, at the subheading "$W_{10/50}$", at the second line of "Xe" please change "0.020" to -- 0.820 --

Table 4 - 1, at the subheading "$W_{17/50}$", at the second line of "Xd" please change "1.663" to -- 1.683 --

Table 4 - 1, at the subheading "$B_8$ (T)", at "Xb" please change "1.068" to -- l.868 --

Table 4 - 1, at the subheading "$B_8$ (T)", at "Xc" please change "1.005" to -- 1.885 --

Table 4 - 1, at the subheading "$B_8$ (T)", at "Xd" please change "1.058" to -- 1.858 --

Table 4 - 1, at the subheading "$B_8$ (T)", at "Xe" please change "1.055" to -- 1.855 --

Table 4 - 1, at the subheading "$B_8$ (T)", at the second line of "Xf" please change "1.094" to -- 1.894 --

Table 4 - 1, at the subheading "$B_8$ (T)", at the second line of "Xg" please change "1.007" to -- 1.887 --

Table 4 - 1, at the subheading "$B_8$ (T)", at "Xh" please change "1.005" to -- 1.885 --

Table 4 - 1, at the subheading "$B_8$ (T)", at "Xi" please change "1.009" to -- 1.889 --

Table 4 - 1, at the subheading "$B_8$ (T)", at the second line of "Xj" please change "1.009" to -- 1.889 --

Table 4 - 1, at the subheading "$B_8$ (T)", at "A3 Xh" please change "1.003" to -- 1.803 --

UNITED STATES PATENT AND TRADEMARK OFFICE

CERTIFICATE OF CORRECTION

PATENT NO. : 6,331,215 B1
DATED : December 18, 2001
INVENTOR(S) : Toge et al.

It is certified that error appears in the above-identified patent and that said Letters Patent is hereby corrected as shown below:

Column 11 and 12,
Table 5, at the subheading "Content of B in MgO (%)", at "YH" please change "0.00" to -- 0.08 --

Column 13 and 14,
Table 6, at the subheading "Condition symbol", at the second row of "A9" please change "YD" to -- YB --
Table 6, at the second row of "A9" at the subheading "Below 1 mm" please change "7B.2" to -- 78.2 --
Table 6, at the subheading "1-4 mm", at "YE" please change "21.0" to -- 21.6 --
Table 6, at the subheading "Average grain diameter (mm)", at "A9" please change "0.04" to -- 0.84 --
Table 6, at the subheading "Content in film (wt %) Ti", at "YE" please change "1.05" to -- 1.85 --
Table 6, at the subheading "Content in film (wt %) B", at "YC" please change "0.00" to -- 0.08 --
Table 6, at the subheading "Content in film (wt %) B", at "YH" please change "0.0B" to -- 0.08 --
Table 6, at the subheading "Iron loss (W/kg) $W_{10/50}$", at "YE" please change "0.36B" to -- 0.368 --

Column 15 and 16,
Table 7, at the subheading "Below 1 mm", at the second row of "A11" please change "12.0" to -- 12.8 --
Table 7, at the subheading "Above 7 mm", at the sixth row of "A11" please change "35.0" to -- 35.8 --
Table 7, at the subheading "Average grain diameter (mm)", at the fifth row of "A11" please change "3.05" to -- 3.85 --
Table 7, at the subheading "Iron loss (wt %) $W_{17/50}$", at "A5" please change "`22.0" to -- >2.0 --
Table 7, at the subheading "$B_8$ (T)", at "A11" please change "1.098" to -- 1.898 --
Table 7, at the subheading "$B_8$ (T)", at the second row of "A11" please change "1.005" to -- 1.885 --
Table 7, at the subheading "$B_8$ (T)", at the third row of "A11" please change "1.063" to -- 1.863 --
Table 7, at the subheading "$B_8$ (T)", at the fourth row of "A11" please change "1.064" to -- 1.864 --
Table 7, at the subheading "$B_8$ (T)", at the fifth row of "A11" please change "1.065" to -- 1.865 --

UNITED STATES PATENT AND TRADEMARK OFFICE

CERTIFICATE OF CORRECTION

PATENT NO. : 6,331,215 B1
DATED : December 18, 2001
INVENTOR(S) : Toge et al.

It is certified that error appears in the above-identified patent and that said Letters Patent is hereby corrected as shown below:

Column 17 and 18,
Table 8, at the subheading "Si", at "B11" please change "2.06" to -- 2.86 --
Table 8, at the subheading "Cu", at "B9" please change "0.0B" to -- 0.08 --
Table 8, at the subheading "B", at "B2" please change "0.0" to -- 0.8 --
Table 8, at the subheading "B", at "B10" please change "0.0" to -- 0.8 -- .
Table 9, at the subheading "FET (°C)", at the fourth row of "B1" please change "970" to -- 870 --
Table 9, at the subheading "Comulative reduction of first 4 passes of a finish hot rolling (%)", at the fifth row of "B1" please change "80.7" to -- 88.7 --
Table 9, at the subheading "$W_{10/50}$ $W_{17/50}$", at the second row of "B1" please change "0.32B" to -- 0.328 --
Table 9, at the subheading "$B_8$ (T)", at the second row of "B1" please change "1.B7" to -- 1.87 --
Table 9, at the subheading "$B_8$ (T)", at the third row of "B1" please change "1.06" to -- 1.86 --
Table 9, at the subheading "$B_8$ (T)", at the fifth row of "B1" please change "1.07" to -- 1.87 --
Table 9, at the subheading "$B_8$ (T)", at "B3" please change "1.09" to -- 1.89 --

Column 19 and 20,
Table 10, at the subheading "Steel symbol", please change "CG" to -- C6 --
Table 10, at the subheading "Si", at "C4" please change "3.00" to -- 3.08 --
Table 11, at the subheading "Magnetic flux density $B_8$ (T)", at D1" please change "1.068" to -- 1.868 --
Table 11, at the subheading "Magnetic flux density $B_8$ (T)", at "D2" please change "1.054" to -- 1.854 --
Table 11, at the subheading "Magnetic flux density $B_8$ (T)", at "D3" please change "1.057" to -- 1.857 --
Table 11, at the subheading "Magnetic flux density $B_8$ (T)", at "D4" please change "1.046" to -- 1.846 --
Table 11, at the subheading "Magnetic flux density $B_8$ (T)", at "D7" please change "1.075" to -- 1.875 --

UNITED STATES PATENT AND TRADEMARK OFFICE

CERTIFICATE OF CORRECTION

PATENT NO. : 6,331,215 B1
DATED : December 18, 2001
INVENTOR(S) : Toge et al.

It is certified that error appears in the above-identified patent and that said Letters Patent is hereby corrected as shown below:

Column 21,
Table 12, at the subheading "Magnetic flux density $B_8$ (T)", at "C4" please change "1.050" to -- 1.850 --
Table 12, at the subheading "Magnetic flux density $B_8$ (T)", at "C5" please change "1.054" to -- 1.854 --
Table 12, at the subheading "Magnetic flux density $B_8$ (T)", at "C6 please change "1.057" to -- 1.857 --
Table 12, at the subheading "Magnetic flux density $B_8$ (T)", at "C7" please change "1.063" to -- 1.863 --
Table 12, at the subheading "Magnetic flux density $B_8$ (T)", at "C8" please change "1.069" to -- 1.869 --

Column 52,
Line 43, after "first 4" please add -- passes --

Column 54,
Line 45, after "first 4" please add -- passes --

Signed and Sealed this

Twelfth Day of November, 2002

*Attest:*

*Attesting Officer*

JAMES E. ROGAN
*Director of the United States Patent and Trademark Office*